US010552726B2

(12) United States Patent
Ohta

(10) Patent No.: US 10,552,726 B2
(45) Date of Patent: Feb. 4, 2020

(54) CARD-TYPE MEDIUM COUNTING MECHANISM, CARD-TYPE MEDIUM HOUSING DEVICE, AND CARD HOUSING DEVICE

(71) Applicant: NIDEC SANKYO CORPORATION, Suwa-gun Nagano (JP)

(72) Inventor: Keiji Ohta, Suwa-gun Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 178 days.

(21) Appl. No.: 15/750,900

(22) PCT Filed: Aug. 3, 2016

(86) PCT No.: PCT/JP2016/072756
§ 371 (c)(1),
(2) Date: Feb. 7, 2018

(87) PCT Pub. No.: WO2017/026339
PCT Pub. Date: Feb. 16, 2017

(65) Prior Publication Data

US 2018/0322379 A1 Nov. 8, 2018

Related U.S. Application Data

(60) Provisional application No. 62/202,436, filed on Aug. 7, 2015.

(30) Foreign Application Priority Data

Jan. 27, 2016 (JP) ..... 2016-013656
Jan. 27, 2016 (JP) ..... 2016-013657
Jan. 27, 2016 (JP) ..... 2016-013658

(51) Int. Cl.
*G06M 9/00* (2006.01)
*B65H 7/14* (2006.01)
*G06M 1/272* (2006.01)

(52) U.S. Cl.
CPC ..... *G06M 9/00* (2013.01); *B65H 7/14* (2013.01); *G06M 1/272* (2013.01); *B65H 2701/1914* (2013.01)

(58) Field of Classification Search
CPC ..... G06M 9/00; G06M 1/272; G06M 7/06; G06M 7/10; B65H 7/14;
(Continued)

(56) References Cited

U.S. PATENT DOCUMENTS 6,636,704 B2 * 10/2003 Weaver ..... B41J 11/0075 399/23
8,727,694 B2 * 5/2014 Hiyama ..... B65H 1/04 187/363

FOREIGN PATENT DOCUMENTS

JP S61272892 A 12/1986
JP H04322550 A 11/1992
(Continued)

OTHER PUBLICATIONS

International Search Report corresponding to Application No. PCT/JP2016/072756; dated Oct. 11, 2016.

*Primary Examiner* — Patrick O Neill
(74) *Attorney, Agent, or Firm* — Cantor Colburn LLP

(57) ABSTRACT

A card-type medium counting mechanism that calculates the number of card-type medium held so as to stack in a thickness direction, which is capable of improving the accuracy with which the number of card-type medium is counted, is provided. A card-type medium counting mechanism that calculates the number of card-type medium includes optical sensors that calculate the number of the card-type medium held so as to stack in a thickness direction
(Continued)

of the card-type medium, a carriage to which the sensors are mounted, a circuit board that is fixed to the carriage, and a carriage driving mechanism that moves the carriage such that the sensors move along an end surface of the card-type medium. In this card-type medium counting mechanism, a processing circuit that processes an output signal from the sensors and outputs a digital signal is mounted to the circuit board.

18 Claims, 12 Drawing Sheets

(58) Field of Classification Search
CPC ..... B65H 2701/1914; B65H 2553/81; B65H 2511/30; B65H 2515/60
See application file for complete search history.

(56) References Cited

FOREIGN PATENT DOCUMENTS

| | | | | | |
|---|---|---|---|---|---|
| JP | H09224520 | A | | 9/1997 | |
| JP | 2008052600 | A | | 3/2008 | |
| JP | 2011065378 | A | | 3/2011 | |
| JP | 2014163873 | A | | 9/2014 | |
| WO | WO-2016134692 | A1 | * | 9/2016 | ..... G06M 9/00 |

* cited by examiner

CARD-TYPE MEDIUM COUNTING MECHANISM, CARD-TYPE MEDIUM HOUSING DEVICE, AND CARD HOUSING DEVICE

CROSS REFERENCE TO RELATED APPLICATIONS

This is the U.S. national stage of application No. PCT/JP2016/072756, filed on Aug. 3, 2016. Priority under 35 U.S.C. § 119 (a) and 35 U.S.C. § 365(b) is claimed from Japanese Applications Nos. 2016-013656, filed Jan. 27, 2016; 2016-013657, filed Jan. 27, 2016; and 2016-013658, filed Jan. 27, 2016 the disclosures of which are incorporated herein by reference. Priority under 35 U.S.C. § 119(e) is claimed from U.S. Provisional Application No. 62/202,436, filed Aug. 7, 2015, the disclosure of which is incorporated herein by reference.

TECHNICAL FIELD

At least an embodiment of the present invention relates to a card-type medium counting mechanism that calculates the number of card-type medium held so as to stack in the thickness direction. At least an embodiment of the present invention also relates to a card-type medium holding device that includes the card-type medium counting mechanism. At least an embodiment of the present invention further relates to a card holding device within which magnetic cards having magnetic stripes are held.

BACKGROUND

A paper sheet counting device for calculating the number of passbooks held stacked in a holding portion is conventionally known (see Patent Literature 1, for example). The paper sheet counting device described in Patent Literature 1 includes two reflective optical sensors each having a light emitting element and a light receiving element. The two optical sensors are arranged parallel to a side corresponding to the back of a passbook. Also, the two optical sensors are able to move in the thickness direction of a passbook held in the holding portion. This paper sheet counting device calculates the number of passbooks held in the holding portion, on the basis of the level (peaks of output signals) of output signals (that is, output signals from the light receiving elements) from the optical sensors when the optical sensors pass the position where the passbook is arranged, and the level (bottoms of the output signals) of the output signals from the optical sensors when the optical sensors passes between stacked passbooks.

CITATION LIST

Patent Literature 1: Japanese Unexamined Patent Application Publication No. 2011-65378

With the paper sheet counting device described in Patent Literature 1, the gap between passbooks held stacked in the holding portion is narrow, so the difference between the peaks and the bottoms of the output signals from the optical sensors is small. Therefore, this paper sheet counting device may not be able to suitably detect the peaks and the bottoms of the output signals from the optical sensors due to noise, and as a result, the accuracy with which the number of passbooks is calculated may decrease.

Thus, at least an embodiment of the present invention provides a card-type medium counting mechanism capable of improving the accuracy with which the number of card-type medium is calculated, in a card-type medium counting mechanism that calculates the number of card-type medium held so as to stack in the thickness direction. Also, at least an embodiment of the present invention provides a card-type medium holding device that includes the card-type medium counting mechanism.

Also, at least an embodiment of the present invention provides a card holding device capable of improving the accuracy with which the number of cards held is calculated, in a card holding device within which magnetic cards having magnetic stripes are held so as to stack in the thickness direction.

To solve the first problem described above, a card-type medium counting mechanism of at least an embodiment of the present invention is a card-type medium counting mechanism that calculates the number of card-type medium, which is characterized by including an optical sensor that calculates the number of card-type medium held so as to stack in a thickness direction of the card-type medium, a carriage to which the sensor is mounted, a circuit board that is fixed to the carriage, and a carriage driving mechanism that drives the carriage such that the sensor moves in the thickness direction of the card-type medium along end surfaces of the card-type medium, in which a processing circuit that processes an output signal from the sensor and outputs a digital signal is mounted to the circuit board.

With the card-type medium counting mechanism of at least an embodiment of the present invention, the circuit board is fixed to the carriage to which the sensor is mounted, and the processing circuit that processes the output signal from the sensor is mounted to this circuit board. Therefore, in at least an embodiment of the present invention, it is possible to process an output signal from the sensor that is less affected by noise with the processing circuit. Also, in at least an embodiment of the present invention, the processing circuit processes the output signal from the sensor and outputs a digital signal, so the output signal from the processing circuit (that is, the output signal from the circuit board) is not easily affected by noise. Therefore, in at least an embodiment of the present invention, even if the difference between the peak and the bottom of the output signal from the sensor when detecting the card-type medium held so as to stack in the thickness direction is small, the effect from noise is able to be suppressed, so the accuracy with which the number of card-type medium is calculated can be improved.

In at least an embodiment of the present invention, the sensor is mounted to the circuit board. According to this kind of configuration, an output signal from the sensor that is less affected by noise than when the sensor is mounted to a different circuit board than the circuit board to which the processing circuit is mounted, and the circuit board to which the processing circuit is mounted and the circuit board to which the sensor is mounted are connected via a cable, can be processed by the processing circuit. Therefore, the accuracy with which the number of card-type medium is calculated can be further improved, even if the difference between the peak and the bottom of the output signal from the sensor is small.

In at least an embodiment of the present invention, the sensor is a reflective optical sensor that includes a light emitting element that emits light toward the card-type medium, and a light receiving element that receives light reflected by the card-type medium, for example.

The card-type medium counting mechanism of at least an embodiment of the present invention can be used in a card-type medium holding device provided with a card-type medium holding portion within which a plurality of card-type medium are held so as to stack in the thickness direction of the card-type medium, and in this card-type medium holding device, the card-type medium counting mechanism is attached to the card-type medium holding portion, and calculates the number of card-type medium held in the card-type medium holding portion. With this card-type medium holding device, the accuracy with which the number of card-type medium is calculated can be improved.

In at least an embodiment of the present invention, the sensor is a reflective optical sensor that includes a light emitting element that emits light toward the card-type medium, and a light receiving element that receives light reflected by the card-type medium, and when one direction in the thickness direction of the card-type medium is a first direction, before counting the number of card-type medium, the carriage is standing by in a home position in which the sensor is arranged on the first direction side of the card-type medium that is arranged farthest to the first direction side inside the card-type medium holding portion, a correcting mark is provided in a position facing the sensor when the carriage is in the home position, and sensitivity of the sensor is automatically corrected on the basis of a detection result at the light receiving element of light emitted from the light emitting element of the sensor and reflected by the correcting mark. According to this configuration, even if the amount of light from the light emitting element or the output from the light receiving element changes due to a change in the environmental conditions of the card-type medium holding device or the operating time of the card-type medium holding device or the like, for example, the number of card-type medium can be accurately calculated on the basis of the output signal from the sensor after the sensitivity has been automatically corrected.

In at least an embodiment of the present invention, the card-type medium counting mechanism is provided with a frame portion that movably holds the carriage and to which the carriage driving mechanism is attached, and the frame portion is detachably attached to the card-type medium holding portion. According to this kind of configuration, the card-type medium counting mechanism is able to be unitized using the frame portion. Therefore, the card-type medium counting mechanism can easily be attached to the card-type medium holding device that is not provided with the card-type medium counting mechanism, and the card-type medium counting mechanism can easily be detached from the card-type medium holding device that is provided with the card-type medium counting mechanism.

To solve the first problem described above, a card-type medium counting mechanism that calculates the number of card-type medium, of another invention of at least an embodiment of the present invention, is characterized by including a plurality of optical sensors that calculate the number of card-type medium held so as to stack in a thickness direction of the card-type medium, a carriage to which the plurality of sensors are mounted, and a carriage driving mechanism that drives the carriage such that the plurality of sensors move in the thickness direction of the card-type medium along end surfaces of the card-type medium, in which at least one sensor among the plurality of sensors, and another sensor excluding this sensor, are mounted to the carriage in a state offset in the thickness direction of the card-type medium.

In at least an embodiment of the present invention, the sensors are reflective optical sensors each of which includes a light emitting element that emits light toward the card-type medium, and a light receiving element that receives light reflected by the card-type medium, for example.

With the card-type medium counting mechanism of at least an embodiment of the present invention, at least one sensor among the plurality of sensors, and another sensor excluding this sensor, are mounted to the carriage in a state offset in the thickness direction of the card-type medium. Therefore, in at least an embodiment of the present invention, the time at which each of the plurality of sensors that are offset in the thickness direction of the card-type medium passes by the end surface of the same card-type medium is different. Therefore, in at least an embodiment of the present invention, it is possible to calculate the number of card-type medium on the basis of a plurality of output signals having different detection timings, which are output from the plurality of sensors, respectively, that are offset in the thickness direction of the card-type medium. Thus, in at least an embodiment of the present invention, it is possible to improve the accuracy with which the number of card-type medium is calculated.

Also, in at least an embodiment of the present invention, it is possible to determine whether the interval between peaks of an output signal from a sensor is wider due to a fluctuation in the rate of movement of the carriage, or whether the interval between peaks of an output signal from a sensor is wider due to the gap between the card-type medium being wider as a result of foreign matter getting in between the card-type medium, for example, on the basis of a plurality of output signals of which the detection timings are different, which are output from the plurality of sensors, respectively, that are offset in the thickness direction of the card-type medium. Also, in at least an embodiment of the present invention, it is possible to determine whether the interval between peaks or the interval between bottoms of an output signal from a sensor is wider or narrower due to a fluctuation in the rate of movement of the carriage, or whether the interval between peaks or the interval between bottoms of an output signal from a sensor is wider or narrower due to a card-type medium of a different thickness being mixed in, for example, on the basis of a plurality of output signals having different detection timings, which are output from the plurality of sensors, respectively, that are offset in the thickness direction of the card-type medium. Therefore, with at least an embodiment of the present invention, it is possible to detect that foreign matter has gotten in between the card-type medium, or detect that a card-type medium of a different thickness is mixed in.

In at least an embodiment of the present invention, the card-type medium counting mechanism includes a circuit board that is fixed to the carriage, and the processing circuit that processes the output signal from the sensor is mounted to this circuit board, and the sensor is mounted to the circuit board. According to this kind of configuration, an output signal from the sensor that is less affected by noise than when the sensor is mounted to a different circuit board than the circuit board to which the processing circuit is mounted, and the circuit board to which the processing circuit is mounted and the circuit board to which the sensor is mounted are connected via a cable, can be processed by the processing circuit. Therefore, the accuracy with which the number of card-type medium is calculated can be further improved, even if the difference between the level of the output signal from the sensor when the sensor passes by the position where the card-type medium is arranged and the level of the output signal from the sensor when the sensor passes between the card-type medium is small.

In at least an embodiment of the present invention, when a direction orthogonal to the emission direction of light from the light emitting element and the thickness direction of the card-type medium is a first direction, each of the plurality of sensors is mounted to the carriage in a state offset from each other in the thickness direction of the card-type medium and offset from each other in the first direction. According to this kind of configuration, it is possible to calculate the number of card-type medium on the basis of the plurality of output signals having different detection timings and detection positions, which are output from the plurality of sensors, respectively, that are offset in the thickness direction of the card-type medium and in the first direction. Therefore, it is possible to improve the accuracy with which the number of card-type medium is calculated.

The card-type medium counting mechanism of at least an embodiment of the present invention is able to be used in a card-type medium holding device provided with a card-type medium holding portion within which a plurality of card-type medium are held so as to stack in the thickness direction of the card-type medium, and in this card-type medium holding device, the card-type medium counting mechanism is attached to the card-type medium holding portion, and calculates the number of card-type medium held in the card-type medium holding portion. With this card-type medium holding device, the accuracy with which the number of card-type medium is calculated can be improved. Also, with this card-type medium holding device, it is possible to detect that foreign matter has gotten in between the card-type medium, or detect that a card-type medium of a different thickness is mixed in.

In at least an embodiment of the present invention, the sensors are reflective optical sensors each of which includes a light emitting element that emits light toward the card-type medium, and a light receiving element that receives light reflected by the card-type medium, and when one direction in the thickness direction of the card-type medium is a second direction, before counting the number of card-type medium, the carriage is standing by in a home position in which the sensors are arranged on the second direction side of the card-type medium that is arranged farthest to the second direction side inside the card-type medium holding portion, a correcting mark is provided in a position facing the sensors when the carriage is in the home position, and sensitivity of the sensors is automatically corrected on the basis of a detection result at the light receiving elements of light emitted from the light emitting elements of the sensors and reflected by the correcting mark. According to this configuration, even if the amount of light from the light emitting elements or the output from the light receiving elements changes due to a change in the environmental conditions of the card-type medium holding device or the operating time of the card-type medium holding device or the like, for example, the number of card-type medium can be accurately calculated on the basis of the output signals from the sensors after the sensitivity has been automatically corrected.

In at least an embodiment of the present invention, the card-type medium counting mechanism includes a frame portion that movably holds the carriage and to which the carriage driving mechanism is attached, and the frame portion is detachably attached to the card-type medium holding portion. According to this kind of configuration, the card-type medium counting mechanism is able to be unitized using the frame portion. Therefore, the card-type medium counting mechanism can easily be attached to the card-type medium holding device that is not provided with the card-type medium counting mechanism, and the card-type medium counting mechanism can easily be can easily be detached from the card-type medium holding device that is provided with the card-type medium counting mechanism.

To solve the second problem described above, a card holding device of at least an embodiment of the present invention is a card holding device in which a rectangular card having a magnetic stripe formed along a longitudinal direction of the card, which is characterized by including card holding portion in which a card is held so as to stack in a thickness direction of the card, a reflective optical sensor that calculates the number of cards held in the card holding portion, a carriage to which the sensor is mounted, and a carriage driving mechanism that moves the carriage such that the sensor moves in the thickness direction of the card along an edge surface of the card, in which the magnetic stripe is formed farther toward one end surface side in a transverse direction of the cards than the center in the transverse direction of the card, the cards are held such that the one end surface of each of the cards faces the same direction in the card holding portion, and when the longitudinal direction of the card held in the card holding portion is a first direction, the transverse direction of the card held in the card holding portion is a second direction, and the side, in the second direction, on which the one end surface of the card is arranged is the magnetic stripe side, the sensor is arranged on the magnetic stripe side of the card holding portion and moves in the thickness direction of the card along the one end surface of the card.

In at least an embodiment of the present invention, the magnetic stripe is formed farther toward the one end surface side in the transverse direction of the card than the center in the transverse direction of the card, and the cards are held such that the one end surface of each of the cards faces the same direction in the card holding portion. Therefore, in at least an embodiment of the present invention, when the transverse direction of the cards held in the card holding portion is the second direction and the side, in the second direction, on which the one end surfaces of the cards are arranged is the magnetic stripe side, a gap between end surfaces (that is, one end surfaces) of the cards on the magnetic stripe side becomes larger than the gap between end surfaces of the cards on the non-magnetic stripe side due to the thickness of the magnetic stripes, in the card holding portion. Also, in at least an embodiment of the present invention, the sensor is arranged on the magnetic stripe side of the card holding portion, and moves in the thickness direction of the cards along the one end surfaces of the cards. That is, in at least an embodiment of the present invention, the sensor moves in the thickness direction of the cards on the one end surface side of the cards where the gap between the cards is wide.

Therefore, in at least an embodiment of the present invention, it is possible to make the difference between the level of the output signal of the sensor when the sensor passes by the positions where the cards are arranged, and the level of the output signal of the sensor when the sensor passes between the cards, relatively large. That is, in at least an embodiment of the present invention, it is possible to make the difference between the peaks and the bottoms of the output signal from the sensor when detecting the card relatively large. Therefore, in at least an embodiment of the present invention, even if there is some noise on the output signal from the sensor, the peaks and the bottoms of the output signal from the sensor can be suitably detected, and as a result, the number of cards held in the card holding portion can be suitably calculated on the basis of the peaks and the bottoms of the output signal from the sensor. Thus, in at least an embodiment of the present invention, it is possible to improve the accuracy with which the number of cards held in the card holding portion is calculated.

In at least an embodiment of the present invention, the card holding portion includes a translucent cover member arranged between the sensor and the cards. According to this kind of configuration, the cover member makes it possible to prevent the light emitting surface of the light emitting element and the light receiving surface of the light receiving element of the sensor from becoming dirty. Also, in this case, a rib that protrudes inward in the second direction is formed on both sides of the cover member in the first direction of the card holding portion. According to this kind of configuration, the cover member is inhibited from being scratched due to the cards held in the card holding portion contacting the cover member.

In at least an embodiment of the present invention, a positioning rib for positioning the cards in the second direction inside the card holding portion is formed protruding inward in the second direction on each of both inside surfaces in the second direction of the card holding portion, and the distance in the second direction between the positioning rib formed on one of the inside surfaces in the second direction of the card holding portion and the positioning rib formed on the other of the inside surfaces in the second direction of the card holding portion is longer than the width in the transverse direction of the card and is shorter than the sum of the width in the transverse direction of the card and a focus range of the sensor. According to this kind of configuration, the card can be held in the card holding portion such that the sensor focuses on the one end surface of the card held in the card holding portion. Also, according to this kind of configuration, the card is more easily held in the card holding portion compared to when the card is positioned in the second direction in the card holding portion by the entire inside surface in the second direction of the card holding portion.

In at least an embodiment of the present invention, the card holding device is provided with a frame portion that movably holds the carriage and to which the carriage driving mechanism is attached, and the frame portion is detachably attached to the card holding portion. According to this kind of configuration, the configuration of the portion that calculates the number of cards is able to be unitized by the frame portion. That is, the card counting mechanism that calculates the number of cards is able to be unitized by the frame portion. Therefore, the card counting mechanism can easily be attached to the card holding device that is not provided with the card counting mechanism, and the card counting mechanism can easily be detached from the card holding device that is provided with the card counting mechanism.

As described above, in at least an embodiment of the present invention, the accuracy with which the number of card-type medium is calculated can be improved, in a card-type medium counting mechanism that calculates the number of card-type medium held so as to stack in the thickness direction. Also, with the card-type medium holding device of at least an embodiment of the present invention, the accuracy with which the number of card-type medium is calculated can be improved.

Also, in at least an embodiment of the present invention, the accuracy with which the number of cards held is calculated can be improved, in a card holding device within which a magnetic card having a magnetic stripe is held so as to stack in the thickness direction.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Below, embodiments of the present invention will be described with reference to the drawings.

(General Configuration of Card-Type Medium Holding Device)

Figure 1:
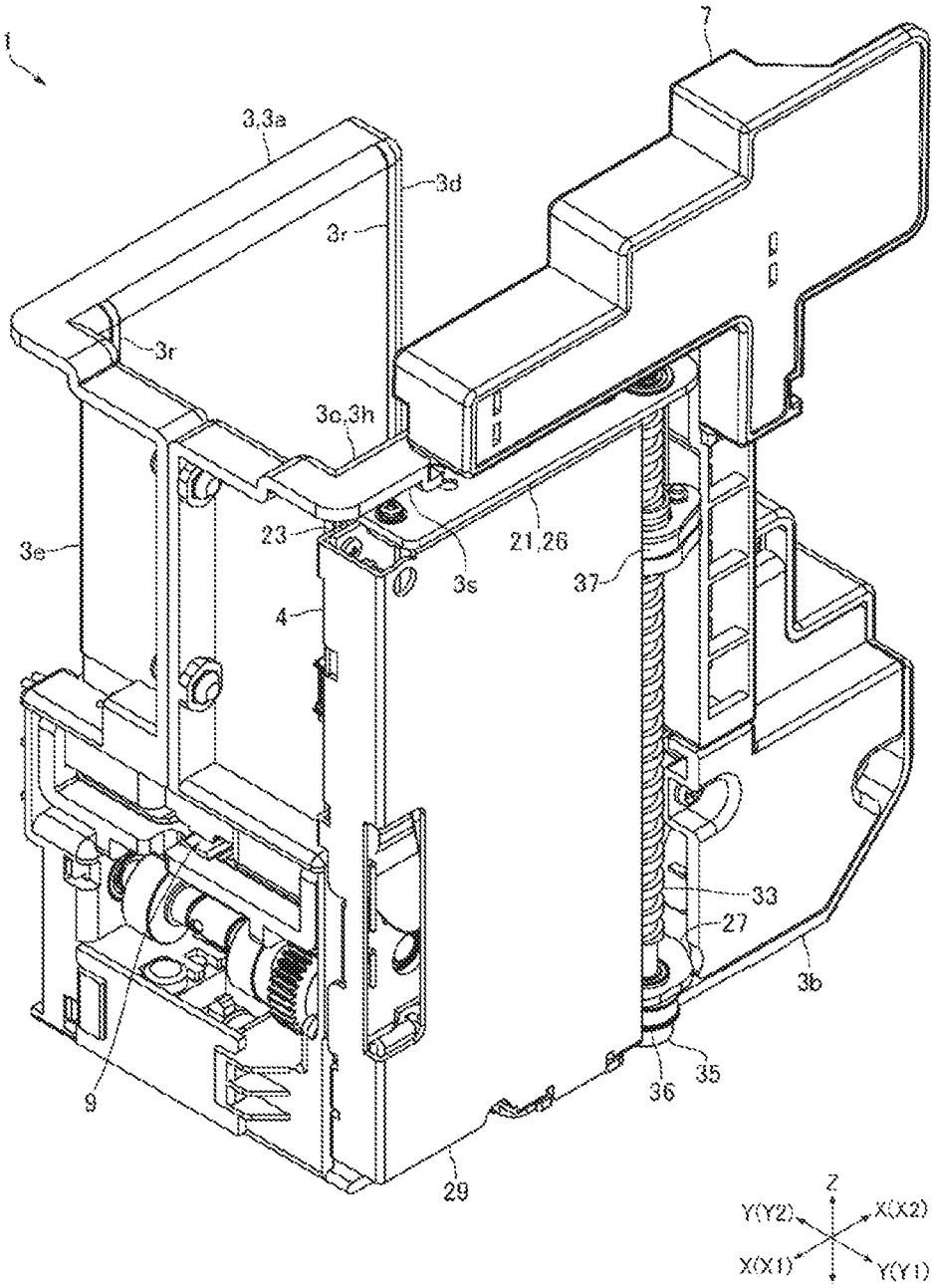
FIG. 1 is a perspective view of a card-type medium holding device according to an embodiment of the present invention.
Figure 2:
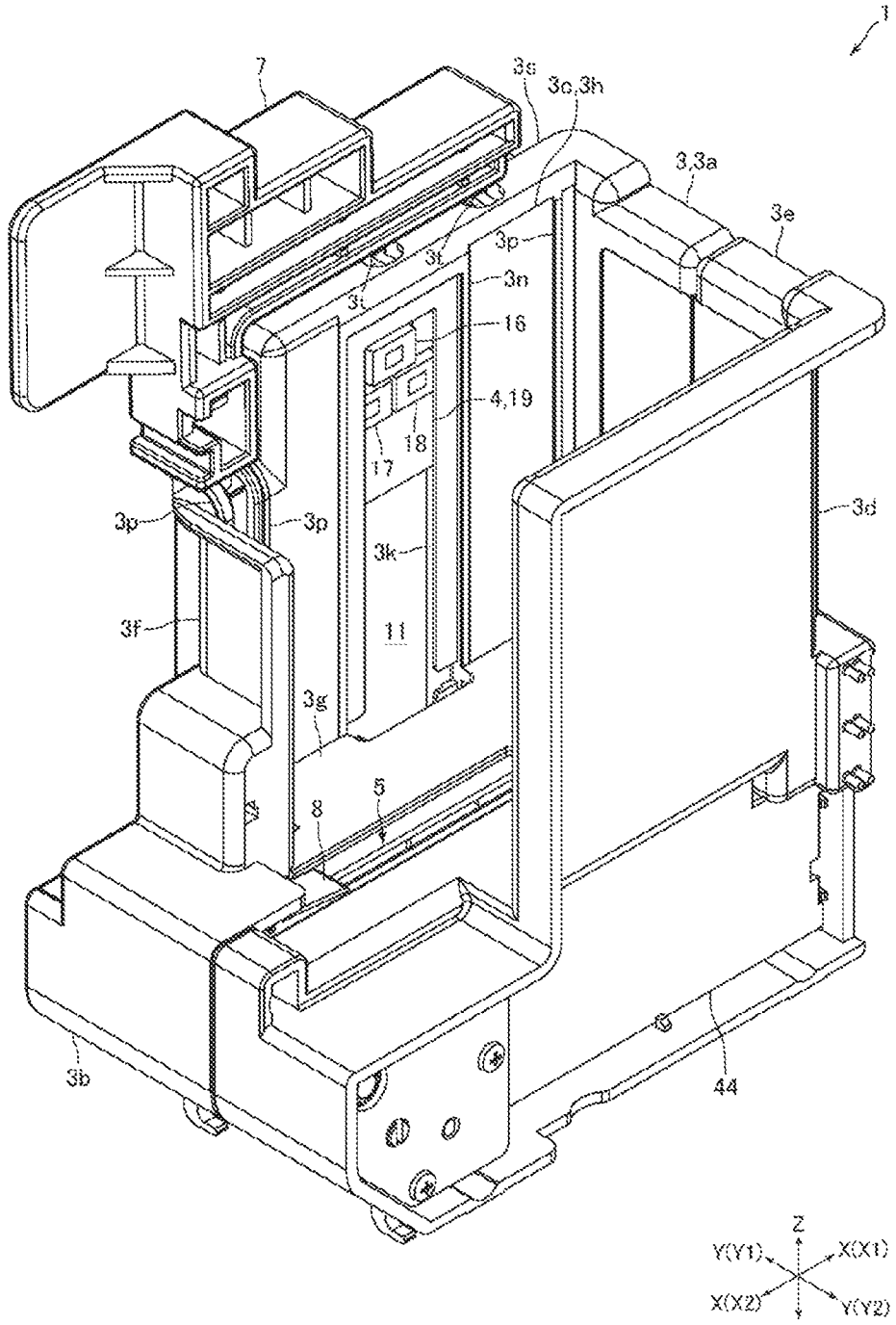
FIG. 2 is a perspective view of the card-type medium holding device illustrated in FIG. 1 shown from another angle.
Figure 3:
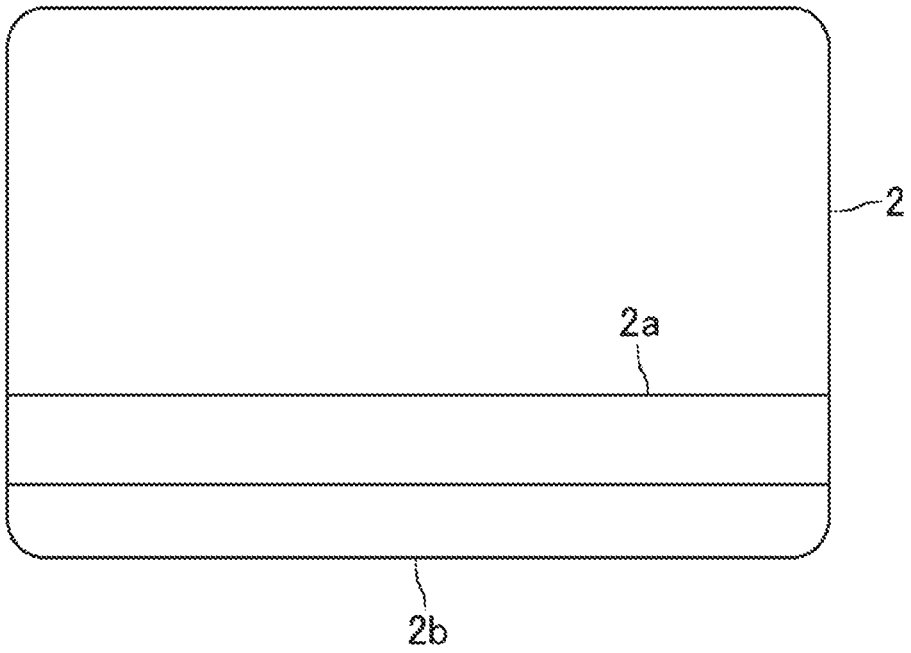
FIG. 3 is a plan view of a card-type medium held in a card-type medium holding portion illustrated in FIG. 1.

FIG. 1 is a perspective view of a card-type medium holding device 1 according to an embodiment of the present invention. FIG. 2 is a perspective view of the card-type medium holding device 1 illustrated in FIG. 1 shown from another angle. FIG. 3 is a plan view of a card-type medium 2 held in a card-type medium holding portion 3 illustrated in FIG. 1.

The card-type medium holding device 1 of the present embodiment is a device that holds a plurality of the card-type medium 2 stacked in the thickness direction of the card-type medium 2. The card-type medium 2 of the present embodiment is a rectangular card made of vinyl chloride and has a thickness of approximately 0.7 to 0.8 mm. Therefore, hereinafter, the card-type medium 2 will be referred to as "card 2", and the card-type medium holding device 1 will be referred to as the "card holding device 1". The card holding device 1 is used mounted to a card issuing device (not shown) for issuing the card 2. This card issuing device is arranged in a bank or the like, and issues new cards 2 (cash cards) to be given to new customers, for example. This card issuing device includes a card reader and a card printer and the like.

The card 2 of the present embodiment is a rectangular card made of vinyl chloride and has a thickness of approximately 0.7 to 0.8 mm. Also, the card 2 is a card (magnetic card) with a magnetic stripe compliant with the international standard (ISO/IEC7811) and the JIS standard (JISX6302), which has a magnetic stripe 2*a* on which magnetic data is recorded, as illustrated in FIG. 3. The magnetic stripe 2*a* is formed in a long thin band shape. This magnetic stripe 2*a* is formed along the longitudinal direction of the card 2 that is formed in a rectangular shape. Also, the magnetic stripe 2*a* is formed farther toward one end surface 2*b* side in the transverse direction of the card 2 than the center in the transverse direction of the card 2. Note that an IC ship may be embedded in the card 2.

The card holding device 1 includes a card holding portion 3 as a card-type medium holding portion within which a plurality of the cards 2 are held so as to stack in the thickness direction of the cards 2, a card counting mechanism 4 as a card-type medium counting mechanism that calculates the number of cards 2 held in the card holding portion 3, and a card delivery mechanism 5 (see FIG. 2) that delivers, one at a time, the cards 2 held in the card holding portion 3. The plurality of the cards 2 are held stacked in the card holding portion 3. That is, the plurality of the cards 2 are held so as to stack in the up-down direction in the card holding portion 3.

The cards 2 in the present embodiment are magnetic cards, with each including the magnetic stripe 2*a* on which magnetic data is recorded, as illustrated in FIG. 3. The magnetic stripe 2*a* is formed in a long thin band shape. This magnetic stripe 2*a* is formed along the longitudinal direction of the card 2 that is formed in a rectangular shape. Also, the magnetic stripe 2*a* is formed farther toward one end surface 2*b* side in the transverse direction of the card 2 than the center in the transverse direction of the card 2. Note that an IC ship may be embedded in the card 2.

In the description below, the vertical direction (Z direction in FIG. 1 and the like) is the up-down direction, the X direction in FIG. 1 and the like that is orthogonal to the up-down direction is the front-rear direction, and the Y direction in FIG. 1 and the like that is orthogonal to the up-down direction and the front-rear direction is the left-right direction. Also, the X1 direction side in the front-rear direction is the "front" side, the X2 direction side that is the opposite side is the "rear (back)" side, the Y1 direction side in the left-right direction is the "right" side, and the Y2 direction side that is the opposite side is the "left" side. In the present embodiment, the up-down direction (Z direction) is the thickness direction of the cards 2. More specifically, the up-down direction is the thickness direction of the cards 2 held in the card holding portion 3.

The card holding portion 3 is formed such that the outer shape of the card holding portion 3 when viewed from the up-down direction is formed in a generally rectangular shape with the front-rear direction being the longitudinal direction. This card holding portion 3 includes a box-shaped holding box portion 3*a* within which the plurality of cards 2 are held stacked, and a support portion 3*b* that supports the holding box portion 3*a* from below. The holding box portion 3*a* is formed by a right side wall section 3*c* that forms a right side surface portion of the holding box portion 3*a*, a left side wall section 3*d* that forms a left side surface portion of the holding box portion 3*a*, a front wall section 3*e* that forms a front surface portion of the holding box portion 3*a*, a rear wall section 3*f* that forms a rear surface portion of the holding box portion 3*a*, and a bottom surface section 3*g* that forms a lower surface portion of the holding box portion 3*a*. The holding box portion 3*a* is formed in a box-shape with the top side and the rear end side open.

The plurality of cards 2 are held inside the holding box portion 3*a* in a manner such that the longitudinal direction (length direction) of the cards 2 matches the front-rear direction, and the transverse direction (width direction) of the cards 2 matches the left-right direction. A weight 7 is attached to the holding box portion 3*a*. This weight 7 is attached to the right side wall section 3*c* in a manner able to slide in the up-down direction, and sits on the plurality of cards 2 held stacked inside the holding box portion 3*a*. The center of gravity of the weight 7 sifting on the cards 2 is to the left side of the center of the cards 2 in the left-right direction (the center in the transverse direction of the cards 2). Note that in FIG. 1 and FIG. 2, and FIG. 4 that will be described later, a state is shown in which the weight 7 has been retracted to the upper end side of the holding box portion 3*a*.

The card delivery mechanism 5 is arranged inside the support portion 3*b*. This card delivery mechanism 5 includes a delivery tab 8 (see FIG. 2) that delivers the cards 2 from the card holding portion 3 one at a time by engaging with the rear end of the card 2 held at the very bottom (the lowermost card 2) of the plurality of cards 2 that are held in the holding box portion 3*a*, and a tab driving mechanism (not shown) that drives the delivery tab 8. A gate 9 (see FIG. 1) through which the card 2 passes toward the front side is formed in the lower end of the front wall section 3*e* of the holding box portion 3*a*. The card delivery mechanism 5 delivers the lowermost card 2 held in the holding box portion 3*a* toward the front side of the card holding portion 3.

(Configuration of Card Holding Portion)

Figure 4:
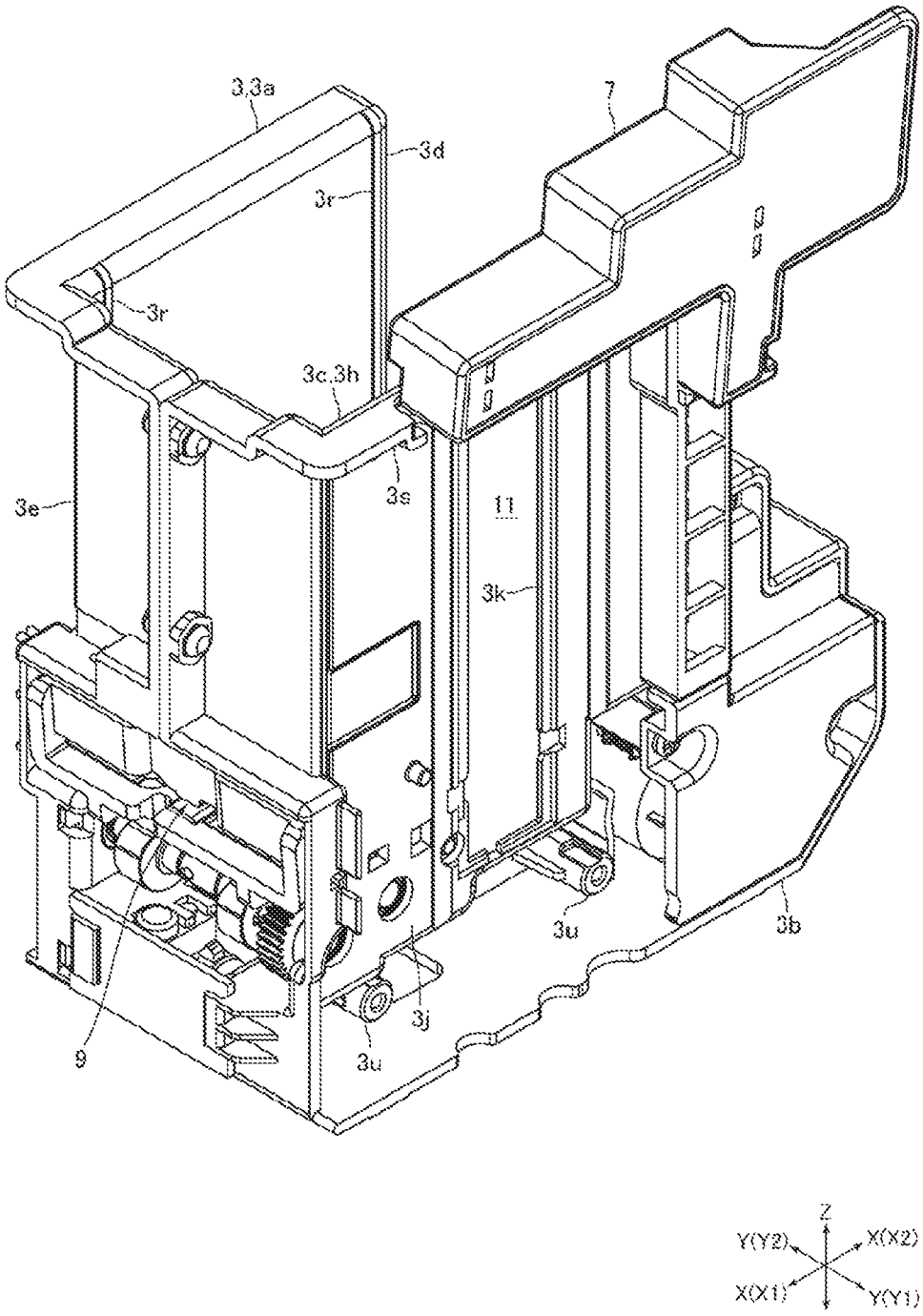
FIG. 4 is a perspective view of a state in which a card-type medium counting mechanism has been removed from the card-type medium holding device illustrated in FIG. 1.
Figure 5:
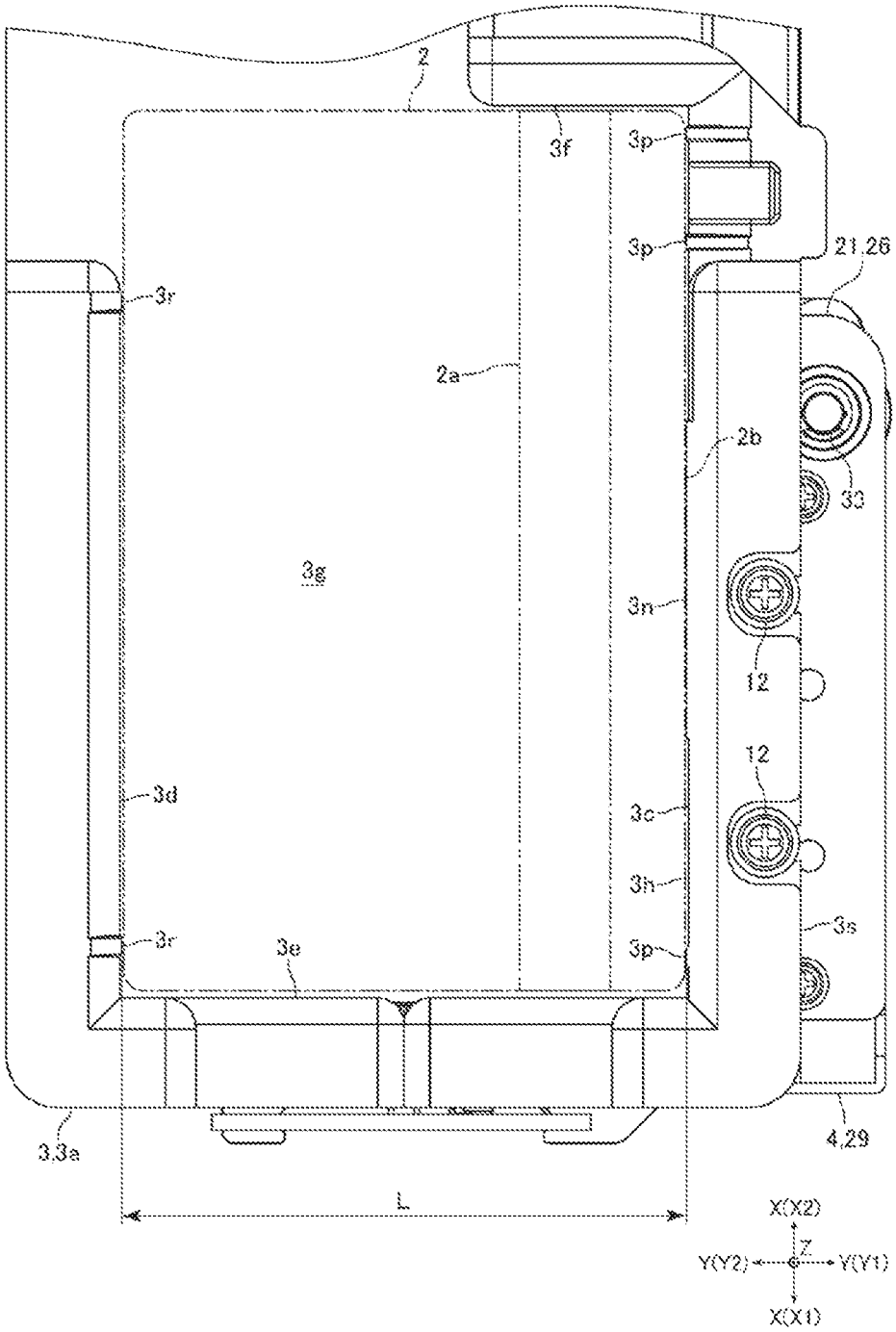
FIG. 5 is a plan view of a portion of the card-type medium holding device illustrated in FIG. 1.
Figure 6:
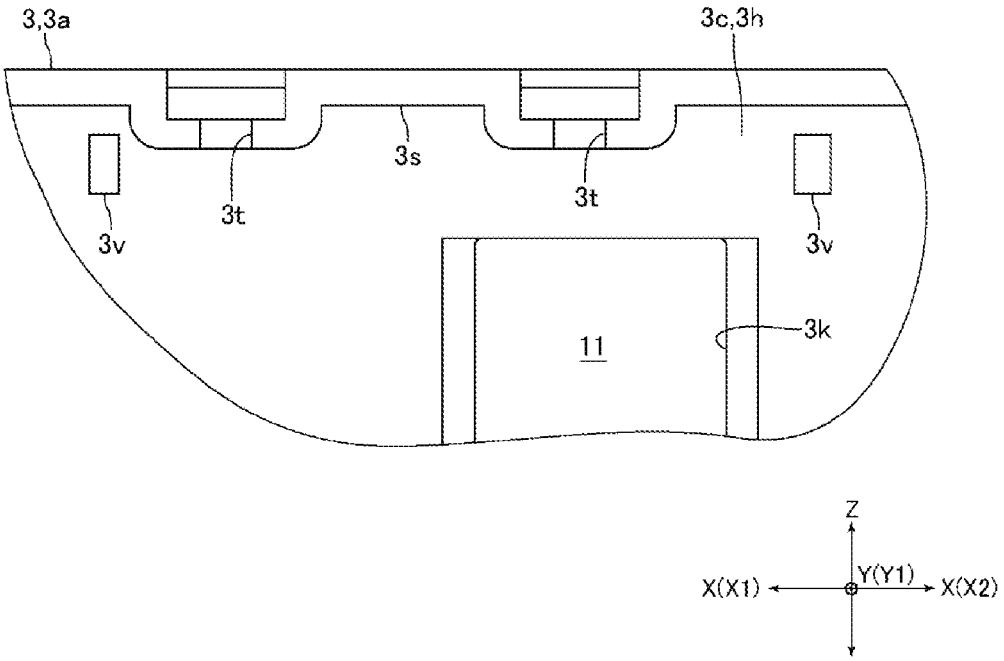
FIG. 6 is a side view of a portion on an upper end side of a right side wall portion of the card-type medium holding portion illustrated in FIG. 4.
Figure 7:
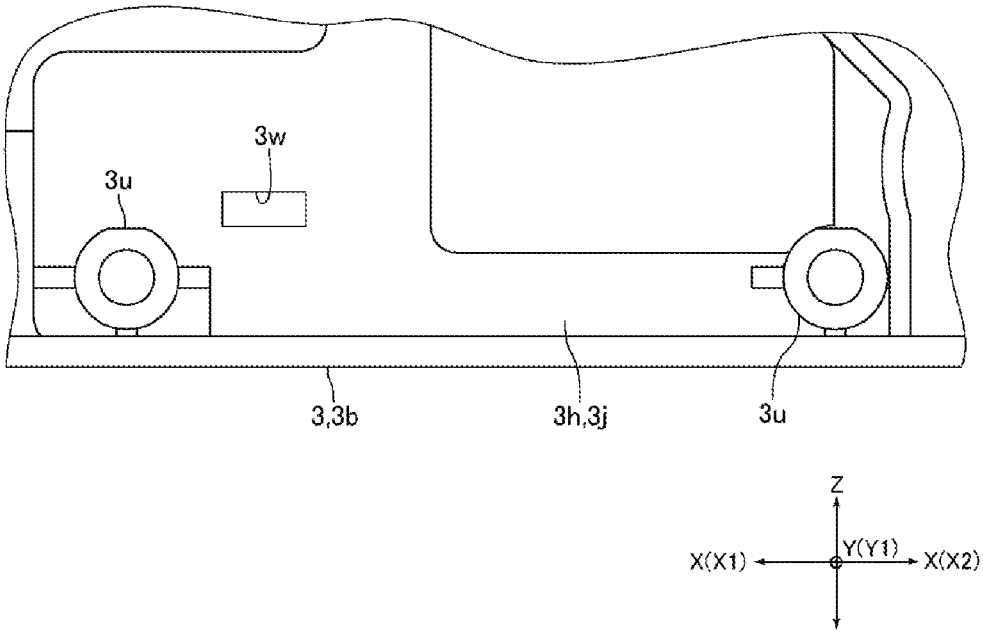
FIG. 7 is a side view of a portion on a lower end side of the right side wall portion of the card-type medium holding portion illustrated in FIG. 4.

FIG. 4 is a perspective view of a state in which the card counting mechanism 4 is removed from the card holding device 1 illustrated in FIG. 1. FIG. 5 is a plan view of a portion of the card holding device 1 illustrated in FIG. 1. FIG. 6 is a side view of a portion on an upper end side of a right side wall portion 3*h* of the card holding portion 3 illustrated in FIG. 4. FIG. 7 is a side view of a portion on a lower end side of the right side wall portion 3*h* of the card holding portion 3 illustrated in FIG. 4.

As described above, the card holding portion 3 is formed such that the outer shape of the card holding portion 3 when viewed from the up-down direction is formed in a generally rectangular shape with the front-rear direction being the longitudinal direction. The card counting mechanism 4 is attached to the right surface of the right side wall portion 3*h* that forms a right side surface portion of the card holding portion 3. That is, the card counting mechanism 4 is attached to the card holding portion 3. The right side wall portion 3*h* is formed by the right side wall section 3*c* of the holding box portion 3*a*, and a right side wall section 3*j* (see FIG. 4) that forms a right side surface portion of the support portion 3*b*. Also, the cards 2 are held such that the one end surface 2*b* in the transverse direction of each of the cards 2 faces the same direction. More specifically, the cards 2 are held such that the one end surface 2*b* in the transverse direction of each of the cards 2 faces toward the right, as illustrated in FIG. 5.

Also, as described above, the plurality of cards are held inside the holding box portion 3*a* of the card holding portion 3 in a manner such that the longitudinal direction of the cards 2 matches the front-rear direction, and the transverse direction of the cards 2 matches the left-right direction.

The front-rear direction (X direction) in the present embodiment is a first direction that is the longitudinal direction of the cards 2 held in the card holding portion 3, and the left-right direction (Y direction) is a second direction that is the transverse direction of the cards 2 held in the card holding portion 3. Also, the right side (Y1 direction side) is the magnetic stripe side that is the side on which the one end surface 2*b* of the cards 2 in the left-right direction is arranged.

The card counting mechanism 4 is attached to the right surface of the right side wall portion 3*h* that forms the right side surface portion of the card holding portion 3. That is, the card counting mechanism 4 is attached to the card holding portion 3. The right side wall portion 3*h* is formed by the right side wall section 3*c* of the holding box portion 3*a*, and the right side wall section 3*j* (see FIG. 4) that forms the right side surface portion of the support portion 3*b*. As described above, the cards 2 are held in the holding box portion 3*a* in a manner such that the one end surface 2*b* in the transverse direction of each of the cards 2 is arranged on the right side, and the card counting mechanism 4 is attached to the card holding portion 3 such that sensors 16 to 18, which will be described later, face the one end surfaces 2*b* of the cards 2 held in the holding box portion 3*a*.

A through-hole 3*k* that passes through in the left-right direction is formed in the right side wall portion 3*h*. The through-hole 3*k* is formed in a rectangular shape with the up-down direction being the longitudinal direction. This through-hole 3*k* is formed in an area extending from the upper end side to the lower end side of the right side wall portion 3*h*. Also, the through-hole 3*k* is formed in a generally central position of the holding box portion 3*a* in the front-rear direction. A cover member 11 made of translucent material having translucency is fixed to the left end side of the through-hole 3*k*. That is, the card holding portion 3 includes the translucent cover member 11. The cover member 11 is formed in a rectangular flat plate shape. Also, the cover member 11 is made of transparent resin material. This cover member 11 is fixed so as to cover the through-hole 3*k*.

A rib 3*n* that protrudes toward the left side is formed on the upper side and both front and rear sides of the cover member 11, on the right side wall section 3*c*. That is, the rib 3*n* is formed on the left surface of the right side wall section 3*c*. The rib 3*n* is formed protruding slightly toward the left side from the left surface of the right side wall section 3*c*. The protrusion amount of the rib 3*n* from the left surface of the right side wall section 3*c* is approximately 0.3 (mm). The left end surface of the rib 3*n* is formed in a flat shape that is orthogonal to the left-right direction. Also, the rib 3*n* is formed on the entire region from the upper end to the lower end of the right side wall section 3*c*, so as to surround the cover member 11 from the upper side and both front and rear sides. Also, the sections of the rib 3*n* that are arranged on both the front and rear sides of the cover member 11 are formed in elongated linear shapes in the up-down direction. The left surface of the cover member 11 is arranged to the right side of the left end surface of the rib 3*n*.

Also, a rib 3*p* that protrudes toward the left side is formed on both front and rear end sides of the right side wall section 3*c*. That is, the rib 3*p* is formed on the left surface of the right side wall section 3*c*. The rib 3*p* is formed in one location on the front end side of the right side wall section 3*c* and in two locations on the rear end side of the right side wall section 3*c*. That is, three ribs 3*p* are formed on the right side wall section 3*c*. These ribs 3*p* are formed protruding slightly toward the left side from the left surface of the right side wall section 3*c*. The left end surfaces of the ribs 3*p* are formed in a flat shape that is orthogonal to the left-right direction. Also, the ribs 3*p* are formed in elongated linear shapes in the up-down direction. The protrusion amounts of the ribs 3*p* from the left surface of the right side wall section 3*c* is equivalent to the protrusion amount of the rib 3*n* from the left surface of the right side wall section 3*c*. That is, the left end surfaces of the ribs 3*p* and the left end surface of the rib 3*n* are arranged on the same plane.

A rib 3*r* that protrudes toward the right side is formed on both front and rear end sides of the left side wall section 3*d*. That is, the rib 3*r* is formed on the right surface of the left side wall section 3*d*. The rib 3*r* is formed in one location on the front end side of the left side wall section 3*d* and in one location on the rear end side of the left side wall section 3*d*. These ribs 3*r* are formed protruding slightly toward the right side from the right surface of the left side wall section 3*d*. The protrusion amount of the rib 3*r* from the right surface of the left side wall section 3*d* is approximately 0.3 (mm). The right end surfaces of the ribs 3*r* are formed in a flat shape that is orthogonal to the left-right direction. Also, the ribs 3*r* are formed in elongated linear shapes in the up-down direction.

The ribs 3*n*, 3*p*, and 3*r* of the present embodiment are positioning ribs for determining the position of the cards 2 in the left-right direction inside the card holding portion 3. That is, in the present embodiment, the positioning ribs 3*n*, 3*p*, and 3*r* for determining the position of the cards 2 in the left-right direction inside the holding box portion 3*a* are each formed protruding toward the inside in the left-right direction on both inside surfaces in the left-right direction of the holding box portion 3*a* of the card holding portion 3.

The distance L (see FIG. 5) in the left-right direction between the left end surfaces of the ribs 3*n* and 3*p* and the right end surfaces of the ribs 3*r* is longer than the width in the transverse direction of the cards 2. Also, the distance L is shorter than the sum of the width in the transverse direction of the cards 2 and the focus range of the sensors 16 to 18, described later, that form the card counting mechanism 4 (more specifically, the focus range (depth of field) of the light receiving elements of the sensors 16 to 18). That is, the distance L in the left-right direction between the ribs 3*n* and 3*p* formed on one inside surface (the left surface of the right side wall section 3*c*) of the holding box portion 3*a* and the ribs 3*r* formed on the other inside surface (the right surface of the left side wall section 3*d*) of the holding box portion 3*a* is longer than the width in the transverse direction of the cards 2, and shorter than the sum of the width in the transverse direction of the cards 2 and the focus range of the sensors 16 to 18 that will be described later.

A fixing portion 3*s* for fixing the card counting mechanism 4 is formed on an upper end of the right side wall section 3*c*. The fixing portion 3*s* is formed in a flange shape that extends out toward the right side from the upper end of the right side wall section 3*c*. Two arrangement grooves 3*t* within which screws 12 (see FIG. 5) for fixing the card counting mechanism 4 are arranged are formed in the fixing portion 3*s*. The arrangement grooves 3*t* are formed in a U-groove shape with the right ends of the arrangement grooves 3*t* open. A fixing protruding portion 3*u* for fixing the card counting mechanism 4 is formed in two locations on the lower end side of the right side wall section 3*j*. These fixing protruding portions 3*u* are formed in cylindrical shapes that protrude toward the right side. The inner peripheral surfaces of the fixing protruding portions 3*u* are screw holes with which screws (not shown) for fixing the card counting mechanism 4 engage. Note that the screws 12 are omitted from FIG. 1 and FIG. 2.

Also, two positioning protrusions 3*v* for positioning the card counting mechanism 4 attached to the card holding portion 3 are formed on an upper end side of the right side wall section 3*c* (see FIG. 6). The positioning protrusions 3*v* are formed protruding toward the right side from the right surface of the right side wall section 3*c*. The two positioning protrusions 3*v* are formed below the fixing portion 3*s* a predetermined distance apart in the front-rear direction. A positioning hole 3*w* for positioning the card holding portion 3 attached to the card holding portion 3 is formed on a lower end side of the right side wall portion 3*h* (see FIG. 7). The positioning hole 3*w* is formed in a square hole shape passing through the right side wall section 3*j*.

(Configuration of Card Counting Mechanism)

Figure 8:
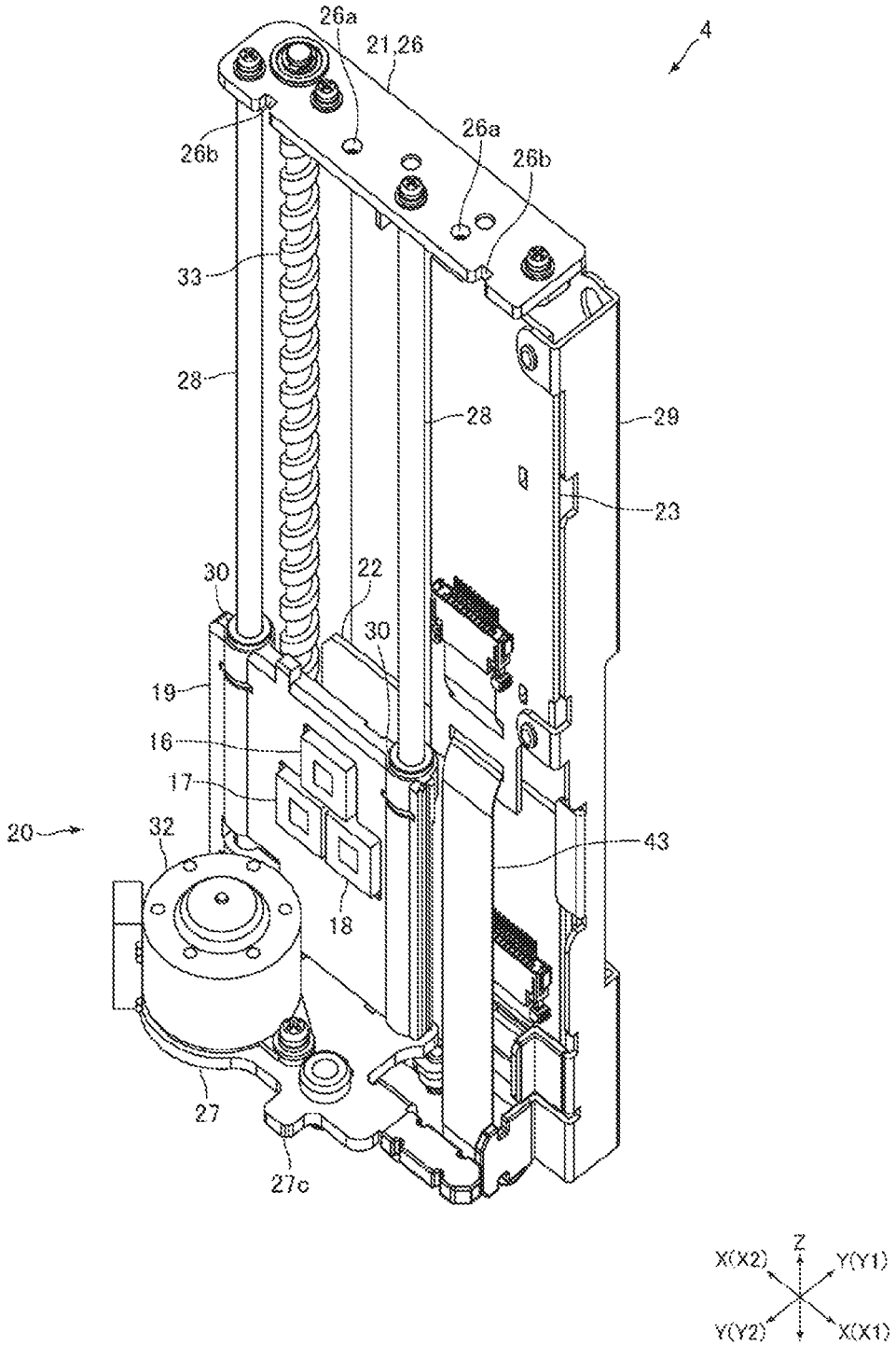
FIG. 8 is a perspective view of the card-type medium counting mechanism illustrated in FIG. 1.
Figure 9:
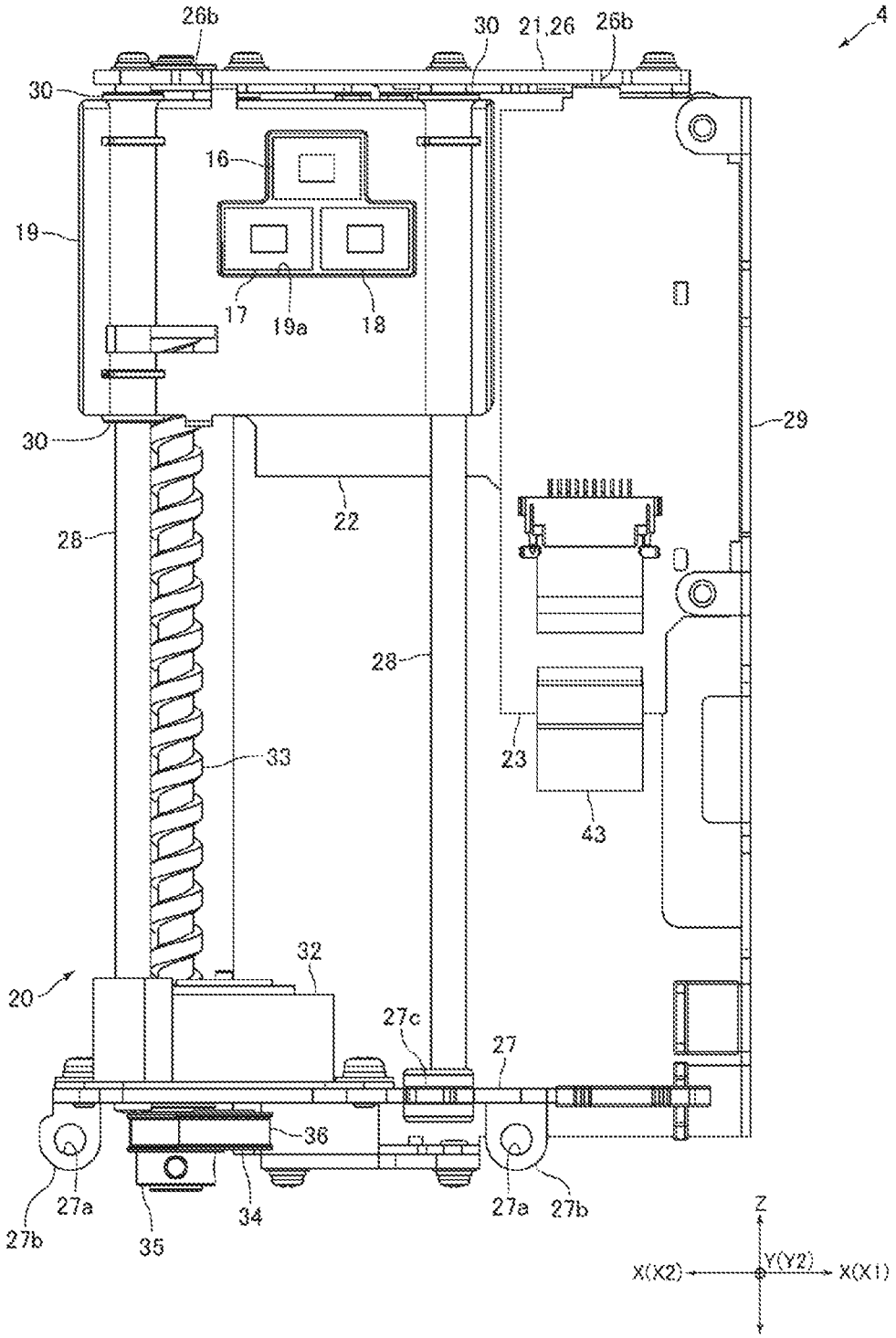
FIG. 9 is a side view of the card-type medium counting mechanism illustrated in FIG. 8.
Figure 10:
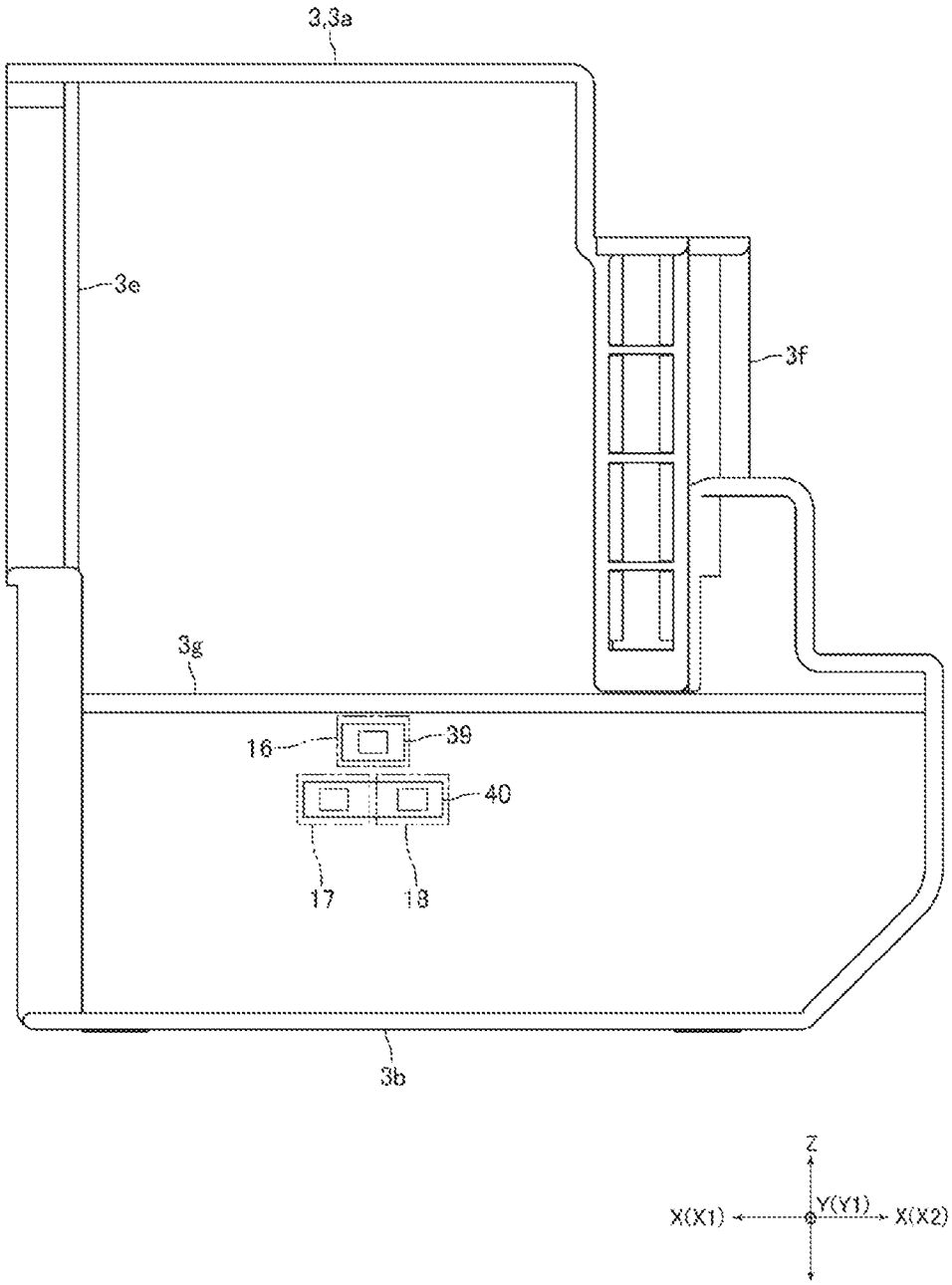
FIG. 10 is a schematic view illustrating the mounting positions of correcting marks for correcting the sensitivity of sensors illustrated in FIG. 8.
Figure 11:
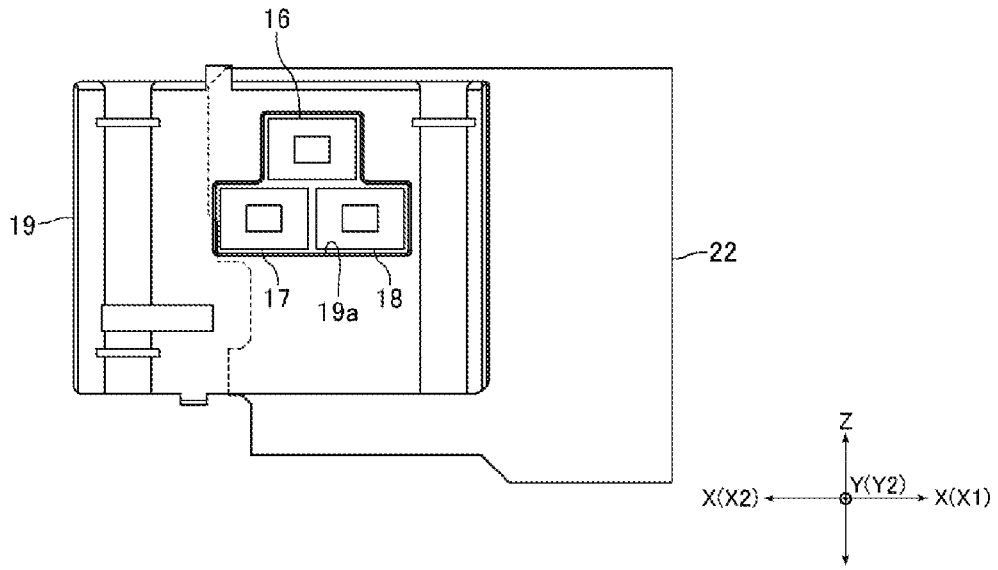
FIG. 11 is a view showing the sensors, carriage, and circuit board illustrated in FIG. 9 extracted.
Figure 12:
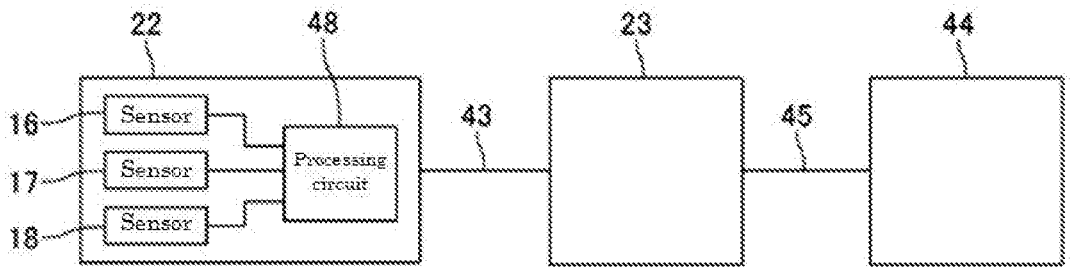
FIG. 12 is a block diagram illustrating the configuration and connective relationship of the circuit board illustrated in FIG. 8.
Figure 13:
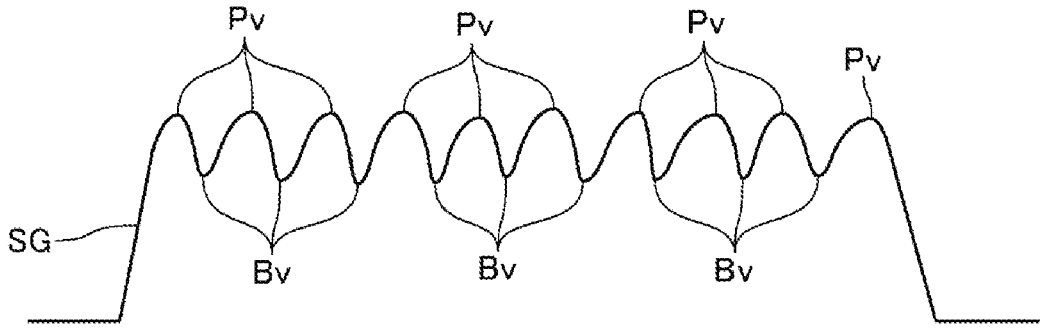
FIG. 13 is a view of an example of an output signal from the sensors illustrated in FIG. 8.

FIG. 8 is a perspective view of the card counting mechanism 4 illustrated in FIG. 1. FIG. 9 is a side view of the card counting mechanism 4 illustrated in FIG. 8. FIG. 10 is a schematic view illustrating the mounting position of correcting marks 39 and 40 for correcting the sensitivity of the sensors illustrated in FIG. 8. FIG. 11 is a view showing the sensors 16 to 18, a carriage 19, and a circuit board 22 illustrated in FIG. 9 extracted. FIG. 12 is a block diagram illustrating the configuration of the circuit board 22 illustrated in FIG. 8 and the connective relationship of circuit boards 22, 23, and 44. FIG. 13 is a view of an example of an output signal SG of the sensors 16 to 18 illustrated in FIG. 8.

The card counting mechanism 4 includes the sensors 16 to 18 for calculating the number of cards 2 held in the card holding portion 3, the carriage 19 to which the sensors 16 to 18 are mounted, and a carriage driving mechanism 20 that moves the carriage 19 in the up-down direction. The card counting mechanism 4 of the present embodiment includes the plurality of sensors 16 to 18. More specifically, the card counting mechanism 4 of the present embodiment includes the three sensors 16 to 18. Also, the card counting mechanism 4 includes a frame portion 21 that movably holds the carriage 19 and to which the carriage driving mechanism 20 is attached, the circuit board 22 that is fixed to the carriage 19, and the circuit board 23 that is fixed to the frame portion 21.

The frame portion 21 is formed by an upper frame 26 that forms an upper end portion of the card counting mechanism 4, a lower frame 27 that forms a lower end portion of the card counting mechanism 4, two guide shafts 28 that connect the upper frame 26 and the lower frame 27 together, and a frame 29 that connects the upper frame 26 and the lower frame 27 together and forms a right side surface portion and a front surface portion of the card counting mechanism 4.

The upper frame 26, the lower frame 27, and the frame 29 are formed by a metal plate. Also, the upper frame 26 is formed in a flat plate shape that is orthogonal to the up-down direction. The lower frame 27, the frame 29, and the frame 29 are formed by a metal plate being bent in a predetermined shape. The two guide shafts 28 are arranged such that the axial direction of the guide shafts 28 matches the up-down direction. Also, the two guide shafts 28 are arranged a predetermined distance apart in the front-rear direction. The upper ends of the guide shafts 28 are fixed to the upper frame 26, and the lower ends of the guide shafts 28 are fixed to the lower frame 27.

Two screw holes 26*a* with which the screws 12 for fixing the card counting mechanism 4 to the card holding portion 3 are formed, as illustrated in FIG. 8, in the upper frame 26. Also, positioning grooves 26*b* with which the positioning protrusions 3*v* of the card holding portion 3 engage are formed in the upper frame 26. The positioning grooves 26*b* are formed recessed toward the right side from the left end surface of the upper frame 26.

The lower frame 27 includes two screw insertion portions 27*b* in which screw insertion holes 27*a* are formed, as illustrated in FIG. 9. The screw insertion portions 27*b* are formed in flat plate shapes that are orthogonal to the left-right direction. Screws (not shown) that engage with the inner peripheral surfaces of the fixing protruding portions 3*u* of the card holding portion 3 are inserted into the screw insertion holes 27*a*. Also, a positioning protrusion 27*c* that engages with the positioning hole 3*w* of the card holding portion 3, as illustrated in FIG. 8, is formed on the lower frame 27. The positioning protrusion 27*c* is formed protruding toward the left side.

The frame portion 21 is detachably attached to the card holding portion 3 by the screws 12 and screws that engage with the inner peripheral surfaces of the fixing protruding portions 3*u*, in a state positioned by the positioning protrusions 3*v* and the positioning hole 3*w* of the card holding portion 3, and the positioning grooves 26*b* and the positioning protrusion 27*c* of the frame portion 21. That is, the card counting mechanism 4 is detachably attached to the card holding portion 3 by the screws 12 and screws that engage with the inner peripheral surfaces of the fixing protruding portions 3*u*, in a state positioned by the positioning protrusions 3*v* and the positioning hole 3*w*, and the positioning grooves 26*b* and the positioning protrusion 27*c*.

The carriage 19 is formed in a generally rectangular flat plate shape, and is arranged such that the thickness direction of the carriage 19 matches the left-right direction. An arrangement hole 19*a* within which the sensors 16 to 18 are arranged, is arranged passing through in the left-right direction in the carriage 19. Also, cylindrical guide bushes 30 into which the guide shafts 28 are inserted are attached to the carriage 19. The circuit board 22 is a rigid board such as a glass epoxy board, and is formed in a flat plate shape. This circuit board 22 is fixed to the right surface of the carriage 19, such that the thickness direction of the circuit board 22 matches the left-right direction.

The sensors 16 to 18 are reflective optical sensors that each includes a light emitting element that emits light toward the cards 2, and a light receiving element that receives light reflected by the cards 2. These sensors 16 to 18 output output signals of which the signal level changes in accordance with the amount of light received by the light receiving elements. The sensors 16 to 18 are mounted to the circuit board 22. That is, the sensors 16 to 18 are mounted to the carriage 19 via the circuit board 22.

Also, the sensors 16 to 18 are mounted to the left surface of the circuit board 22, and are arranged such that the light emitting surfaces of the light emitting elements and the light receiving surfaces of the light emitting elements face the left side. The sensors 16 to 18 are arranged in the arrangement hole 19*a* of the carriage 19. The left end surfaces of the sensors 16 to 18 are arranged on the same plane. Also, the left end surfaces of the sensors 16 to 18 are arranged to the left side of the left surface of the carriage 19. The left direction (Y2 direction) in the present embodiment is the emission direction of the light from the light emitting elements of the sensors 16 to 18, and the front-rear direction (X direction) is a first direction that is orthogonal to both the up-down direction that is the thickness direction of the cards 2 and the emission direction of the light from the light emitting elements of the sensors 16 to 18.

The carriage driving mechanism 20 includes a motor 32 and a lead screw 33 that rotates by the power of the motor 32. The motor 32 is fixed to the lower frame 27. The lead screw 33 is rotatably held by the frame portion 21 such that the axial direction of the lead screw 33 matches the up-down direction. More specifically, the upper end side of the lead screw 33 is rotatably held by the upper frame 26, and the lower end side of the lead screw 33 is rotatably held by the lower frame 27. As illustrated in FIG. 9, the lower end side of the lead screw 33 is connected to the motor 32 via pulleys 34 and 35 and a belt 36. Also, a nut member 37 (see FIG. 1) is engaged with the lead screw 33, and the nut member 37 is held by the carriage 19. When the motor 32 is driven, the carriage 19 moves in the up-down direction along the guide shafts 28.

The sensor 17 and the sensor 18 are arranged at the same height. Also, the sensor 17 and the sensor 18 are arranged adjacent in the front-rear direction. The sensor 16 is arranged above the sensors 17 and 18. That is, one sensor 16 of the three sensors 16 to 18, and the other two sensors 17 and 18 excluding this sensor 16, are mounted to the carriage 19 in a state offset in the up-down direction. Also, the sensor 16 is arranged such that the middle position between the sensor 17 and the sensor 18 in the front-rear direction substantially matches the center of the sensor 16 in the front-rear direction. That is, each of the three sensors 16 to 18 is mounted to the carriage 19 in a state offset from each other in the front-rear direction.

As described above, the card counting mechanism 4 is attached to the right surface of the right side wall portion 3*h* of the card holding portion 3, and the sensors 16 to 18 are arranged on the right side of the card holding portion 3. Also, the sensor 16 and the sensor 18 are arranged in the same position as the cover member 11 in the front-rear direction. That is, the sensors 16 to 18 are arranged such that the light emitting surfaces of the light emitting elements and the light receiving surfaces of the light receiving elements of the sensors 16 to 18 face, in left-right direction via the transparent cover member 11, the one end surfaces 2*b* of the cards 2 held in the card holding portion 3, and the cover member 11 is arranged between the cards 2 held in the card holding portion 3 and the sensors 16 to 18.

Also, the sensors 16 to 18 are arranged in the same position as the cover member 11 in the front-rear direction. That is, the sensors 16 to 18 are arranged such that the light emitting surfaces of the light emitting elements and the light receiving surfaces of the light receiving elements of the sensors 16 to 18 face, in left-right direction via the transparent cover member 11, the one end surfaces 2*b* of the cards 2 held in the card holding portion 3, and the cover member 11 is arranged between the sensors 16 to 18 and the cards 2. Also, the sensors 16 to 18 move in the up-down direction that is the thickness direction of the cards 2 along the one end surfaces 2*b* of the cards 2 held in the card holding portion 3. More specifically, the sensors 16 to 18 move in the up-down direction along the one end surfaces 2*b* of the cards 2, between the lowermost position illustrated in FIG. 8 and the uppermost position illustrated in FIG. 9. That is, the carriage 19 moves in the up-down direction between the lowermost position illustrated in FIG. 8 and the uppermost position illustrated in FIG. 9.

When the sensors 16 to 18 are in the lowermost position, the sensors 16 to 18 are arranged below the bottom surface section 3*g*, as illustrated in FIG. 10. That is, when the sensors 16 to 18 are in the lowermost position, the sensors 16 to 18 are arranged below the lowermost card 2 that is arranged on the lowermost side inside the card holding portion 3. Also, when the sensors 16 to 18 are in the uppermost position, the sensors 16 to 18 are arranged above the card 2 that is arranged on the uppermost side inside the card holding portion 3. More specifically, even when the maximum number of cards 2 able to be held in the card holding portion 3 are held, when the sensors 16 to 18 are in the uppermost position, the sensors 16 to 18 are arranged above the card 2 that is arranged on the uppermost side inside the card holding portion 3.

In the present embodiment, before counting the number of cards 2 held in the card holding portion 3, the carriage 19 is standing by in the lowermost position illustrated in FIG. 8. That is, before counting the number of cards 2, the carriage 19 is standing by in the home position in which the sensors 16 to 18 are arranged below the lowermost card 2. The down direction in this embodiment is a first direction that is one direction in the thickness direction of the cards 2.

The correcting marks 39 and 40 for correcting the sensitivity of the sensors 16 to 18 are provided, as illustrated in FIG. 10, in positions facing the sensors 16 to 18 when the carriage 19 is in the home position. More specifically, the correcting marks 39 and 40 are provided on the support portion 3*b* of the card holding portion 3. The correcting marks 39 and 40 are, for example, tape in which the surface facing the sensors 16 to 18 is colored white. Also, for example, the correcting mark 39 is provided in a position facing the sensor 16, and the correcting mark 40 is provided in a position facing the sensors 17 and 18. Note that one correcting mark that faces all of the three sensors 16 to 18 may be provided, or three correcting marks each facing one of the three sensors 16 to 18 may be provided.

In the present embodiment, when the carriage 19 is in the home position, the light emitting elements of the sensors 16 to 18 emit light toward the correcting marks 39 and 40. Also, the sensitivity of the sensors 16 to 18 is automatically corrected on the basis of a detection result at the light receiving elements of the sensors 16 to 18, of the light emitted from the light emitting elements of the sensors 16 to 18 and reflected by the correcting marks 39 and 40. More specifically, the amount of light emitted by the light emitting elements of the sensors 16 to 18, and the gain of an amplifier circuit that forms part of a processing circuit 48, that will be described later, and the like are adjusted. Note that the automatic correction circuit for automatically correcting the sensitivity of the sensors 16 to 18 is mounted to the circuit board 22, for example.

The circuit board 23 is a rigid board such as a glass epoxy board, and is formed in a flat plate shape. This circuit board 23 is fixed to the frame 29 such that the thickness direction of the circuit board 23 matches the left-right direction. Also, the circuit board 23 is arranged adjacent to the carriage 19 in the front-rear direction, and the circuit board 22 is arranged on the right side of the circuit board 23. The circuit board 22 and the circuit board 23 are connected via a cable 43. The cable 43 is a flexible printed circuit board. One end of the cable 43 is connected to the lower end side of the circuit board 22, and the other end of the cable 43 is connected to the lower end side of the circuit board 23, and the cable 43 is bent under the circuit boards 22 and 23.

Also, the circuit board 23 is connected, via a cable 45, to the circuit board 44 (see FIG. 2 and FIG. 12) that is fixed to the card holding portion 3. The circuit board 44 is a rigid board such as a glass epoxy board, and is formed in a flat plate shape. This circuit board 44 is fixed to the left side surface of the support portion 3*b* of the card holding portion 3. The cable 45 is a lead wire, for example, and is first pulled out below the frame portion 21 and then pulled around to the left side toward the circuit board 44. Note that a connector is fixed to the tip end of the cable 45, and this connector engages with a connector mounted to the circuit board 44.

A processing circuit 48 that processes the output signals from the sensors 16 to 18 is mounted to the circuit board 22. The processing circuit 48 includes an amplifier circuit, an A/D conversion circuit, and a CPU. When the carriage 19 that is in the home position moves to the uppermost position, an analog output signal SG as illustrated in FIG. 13 is output from the sensors 16 to 18, for example. The processing circuit 48 calculates the number of cards 2 held in the card holding portion 3 on the basis of this analog output signal SG. More specifically, the processing circuit 48 calculates the number of cards 2 held in the card holding portion 3 on the basis of the number of peaks Pv and the number of bottoms By of the output signal SG.

Note that the gaps between the cards 2 held in the card holding portion 3 are narrow, so the difference between the level of the output signals from the sensors 16 to 18 when the sensors 16 to 18 pass by the positions where the cards 2 are arranged, and the level of the output signals from the sensors 16 to 18 when the sensors 16 to 18 pass between the cards 2, is small. That is, the difference between the peaks Pv and the bottoms By of the output signal SG of the sensors 16 to 18 when detecting the cards 2 held in the card holding portion 3 is small.

Also, the processing circuit 48 outputs the calculation result of the number of cards 2 as a digital signal. The digital signal output from the processing circuit 48 is input to the circuit board 44 via the cable 43, the circuit board 23, and the cable 45. Note that in the present embodiment, a control circuit of the card counting mechanism 4 is mounted to the circuit board 44. Also, a control circuit of the card delivery mechanism 5 is also mounted to the circuit board 44. Also, a drive circuit of the carriage driving mechanism 20 and the like is mounted to the circuit board 23.

(Main Effects of the Present Embodiment)

As described above, in the present embodiment, the circuit board 22 is fixed to the carriage 19 on which the sensors 16 to 18 are mounted, and the processing circuit 48 that processes the output signal SG from the sensors 16 to 18 is mounted to the circuit board 22. Therefore, in the present embodiment, it is possible to process the output signal SG from the sensors 16 to 18 that is less affected by noise with the processing circuit 48. In particular, in the present embodiment, the sensors 16 to 18 are mounted to circuit board 22, so the output signal SG from the sensors 16 to 18 that is less affected by noise than when the sensors 16 to 18 are mounted to a different circuit board than the circuit board 22, and this circuit board and the circuit board 22 are connected via a predetermined cable, can be processed by the processing circuit 48. Also, in the present embodiment, the processing circuit 48 outputs the calculation result of the number of cards 2 as a digital signal, and the digital signal processed by the processing circuit 48 is input to the circuit board 44 via the cables 43 and 45 and the circuit board 23. Therefore, in the present embodiment, the signal output from the processing circuit 48 and input to the circuit board 44 via the cables 43 and 45 and the circuit board 23 is not easily affected by noise.

In this kind of present embodiment, the output signal SG that is less affected by noise can be processed by the processing circuit 48, and the signal that is output from the processing circuit 48 and input to the circuit board 44 via the cables 43 and 45 and the circuit board 23 is not easily affected by noise. Therefore, in the present embodiment, as described above, even if the difference between the peaks Pv and the bottoms By of the output signal SG of the sensors 16 to 18 when detecting the cards 2 held in the card holding portion 3 is small, the effect from noise is able to be suppressed, so the accuracy with which the number of cards 2 is calculated can be improved.

In the present embodiment, the sensitivity of the sensors 16 to 18 is automatically corrected on the basis of a detection result at the light receiving elements of the sensors 16 to 18, of the light emitted from the light emitting elements of the sensors 16 to 18 and reflected by the correcting marks 39 and 40. Therefore, in the present embodiment, even if the amount of light from the light emitting elements or the output from the light receiving elements of the sensors 16 to 18 changes due to a change in the environmental conditions of the card holding device 1 or the operating time of the card holding device 1 or the like, for example, the number of cards 2 can be accurately calculated on the basis of the output signal SG from the sensors 16 to 18 after the sensitivity has been automatically corrected.

In the present embodiment, the card counting mechanism 4 includes the frame portion 21 that movably holds the carriage 19 and to which the carriage driving mechanism 20 is attached. Therefore, in the present embodiment, the card counting mechanism 4 is able to be unitized using the frame portion 21. Also, in the present embodiment, the frame portion 21 is detachably attached to the card holding portion 3 by the screws 12 and the screws that engage with the inner peripheral surfaces of the fixing protruding portions 3*u*, in a state positioned by the positioning protrusions 3*v* and the positioning hole 3*w* of the card holding portion 3, and the positioning grooves 26*b* and the positioning protrusion 27*c* of the frame portion 21. Therefore, in the present embodiment, the card counting mechanism 4 can easily be attached to the card holding device 1 that is not provided with the card counting mechanism 4, and the card counting mechanism 4 can easily be detached from the card holding device 1 that is provided with the card counting mechanism 4.

In the present embodiment, the magnetic stripe 2*a* is formed farther toward the one end surface 2*b* side in the transverse direction of the card 2 than the center in the transverse direction of the card 2, and the card 2 is held in the card holding portion 3 such that the one end surface 2*b* in the transverse direction of the card 2 faces toward the right. Therefore, in the present embodiment, the gap between the right end surfaces (that is, the one end surfaces 2*b*) of a plurality of the cards 2 held in the card holding portion 3 is larger than the gap between the left end surfaces of the cards 2, due to the thickness of the magnetic stripe 2*a*. Also, in the present embodiment, the sensors 16 to 18 are arranged on the right side of the card holding portion 3 so that the light emitting surfaces of the light emitting elements and the light receiving surfaces of the light receiving elements of the sensors 16 to 18 face the left side, and the sensors 16 to 18 move in the up-down direction that is the thickness direction of the cards 2 along the one end surfaces 2*b* of the cards 2 held in the card holding portion 3. That is, in the present embodiment, the sensors 16 to 18 move in the up-down direction on the one end surface 2*b* side where the gap between the cards 2 is wide.

Therefore, in the present embodiment, it is possible to make the difference between the level of the output signal SG of the sensors 16 to 18 when the sensors 16 to 18 pass by the positions where the cards 2 are arranged, and the level of the output signal SG of the sensors 16 to 18 when the sensors 16 to 18 pass between the cards 2, relatively large. That is, in the present embodiment, it is possible to make the difference between the peaks Pv and the bottoms By of the output signal SG of the sensors 16 to 18 detecting the cards 2, relatively large. Therefore, in the present embodiment, even if there is some noise on the output signal SG from the sensors 16 to 18, the peaks Pv and the bottoms By of the output signal SG from the sensors 16 to 18 can be suitably detected, and as a result, the number of cards 2 held in the card holding portion 3 can be suitably calculated on the basis of the peaks Pv and the bottoms By of the output signal SG from the sensors 16 to 18. Thus, in the present embodiment, it is possible to improve the accuracy with which the number of cards 2 held in the card holding portion 3 is calculated.

In particular, in the present embodiment, the center of gravity of the weight 7 sifting on the cards 2 is to the left side of the center of the cards 2 in the left-right direction, so the gap between the right end surfaces (that is, the one end surfaces 2*b*) of the plurality of cards 2 held in the card holding portion 3 tends to be larger. Therefore, in the present embodiment, it is possible to make the difference between the level of the output signal SG from the sensors 16 to 18 when the sensors 16 to 18 pass by the positions where the cards 2 are arranged, and the level of the output signal SG from the sensors 16 to 18 when the sensors 16 to 18 pass between the cards 2, relatively large. Also, the center of gravity of the weight 7 sifting on the cards 2 is to the left side of the center of the cards 2 in the left-right direction, so even if cards 2 that are bent are held in the card holding portion 3, the gap between the right end surfaces of the plurality of cards 2 held in the card holding portion 3 is able to be made larger than the gap between the left end surfaces of the cards 2.

As described above, in the present embodiment, the sensor 16 and the sensors 17 and 18 are mounted to the carriage 19 in a state offset in the up-down direction that is the thickness direction of the cards 2 held in the card holding portion 3. Therefore, in the present embodiment, the time at which the sensor 16 passes by the one end surface 2*b* of a certain card 2 is different from the time at which the sensors 17 and 18 pass by the one end surface 2*b* of the same card 2. That is, in the present embodiment, the detection timing of the card 2 by the sensor 16 is different from the detection timing of the card 2 by the sensors 17 and 18. Therefore, in the present embodiment, the number of cards 2 can be calculated on the basis of the output signal from the sensor 16, and the output signal from the sensor 17 and the output signal from the sensor 18, of which the detection timing is different from the detection timing of the output signal of the sensor 16. As a result, in the present embodiment, it is possible to improve the accuracy with which the number of cards 2 is calculated.

Figure 14:
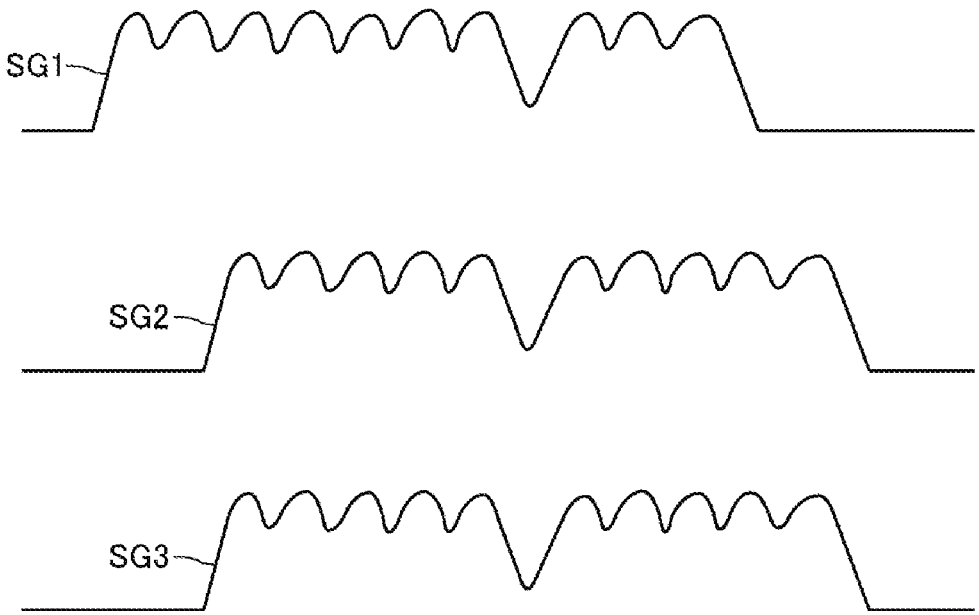
FIG. 14 is a view of an example of output signals from the sensors illustrated in FIG. 8.
Figure 15:
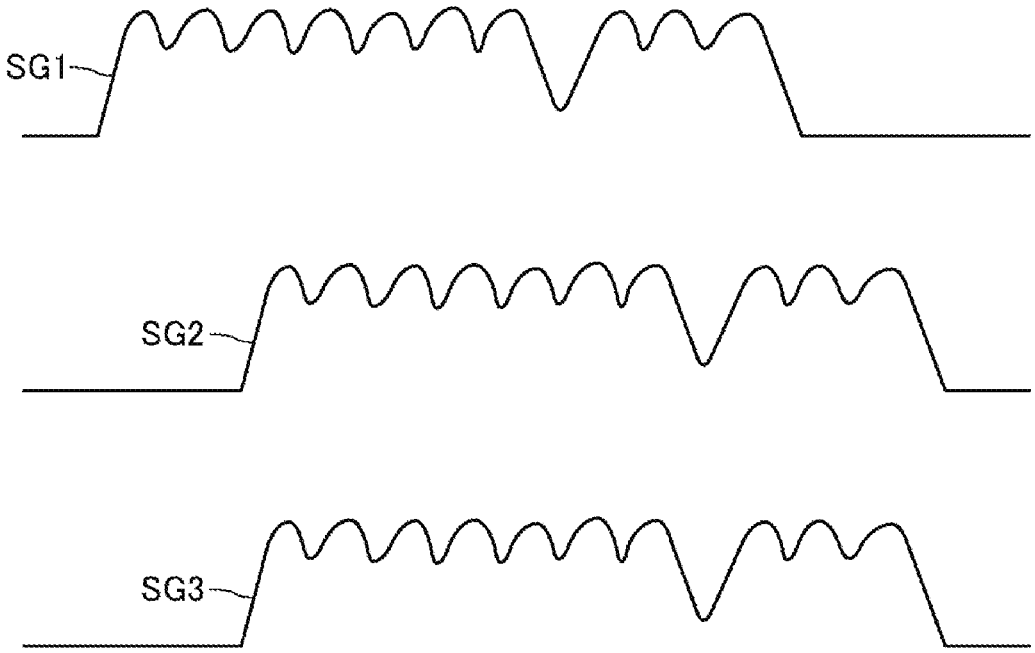
FIG. 15 is a view of an example of output signals from the sensors illustrated in FIG. 8.

Also, in the present embodiment, it is possible to determine whether the interval between peaks of the output signal from the sensors 16 to 18 is wider due to a change in the rate of movement of the carriage 19, or whether the interval between peaks of the output signal from the sensors 16 to 18 is wider due to the gap between the cards 2 being wider as a result of there being foreign matter between the cards 2, for example, on the basis of the output signal from the sensor 16 and the output signals from the sensors 17 and 18, of which the different detection timings are different. That is, when the interval of the peaks of the output signal from the sensors 16 to 18 becomes wider due to a change in the rate of movement of the carriage 19, then in an output signal SG1 from the sensor 16, an output signal SG2 from the sensor 17, and an output signal SG3 from the sensor 18, the intervals of the peaks of the output signals SG1 to SG3 become wider at the same time, as illustrated in FIG. 14. On the other hand, for example, when the intervals of the peaks of the output signals from the sensors 16 to 18 become wider due to the gap between the cards 2 being wider, the time at which the interval of the peaks in the output signal SG1 from the sensor 16 becomes wider is different from the time at which the intervals of the peaks in the output signal SG2 from the sensor 17 and the output signal SG3 from the sensor 18 become wider, as illustrated in FIG. 15, and the space between an nth (where n is a natural number) peak and an n+1 peak from the left end in FIG. 15 becomes wider in all of the output signals SG1 to SG3. Therefore, in the present embodiment, it is possible to determine whether the intervals between peaks of the output signals from the sensors 16 to 18 are wider due to a change in the rate of movement of the carriage 19, or whether the intervals between peaks of the output signals from the sensors 16 to 18 are wider due to the gap between the cards 2 being wider as a result of there being foreign matter between the cards 2, for example, on the basis of the output signals SG1 to SG3.

Similarly, in the present embodiment, it is possible to determine whether the intervals between the peaks or the intervals between the bottoms of the output signals SG1 to SG3 are wider or narrower due to a change in the rate of movement of the carriage 19, or whether the intervals between the peaks or the intervals between the bottoms of the output signals SG1 to SG3 are wider or narrower due to a card 2 of a different thickness being mixed in, for example, on the basis of the output signals SG1 to SG3. Therefore, with the present embodiment, it is possible to detect that foreign matter has gotten in between the cards 2, and detect that a card 2 of a different thickness is mixed in.

Figure 16:
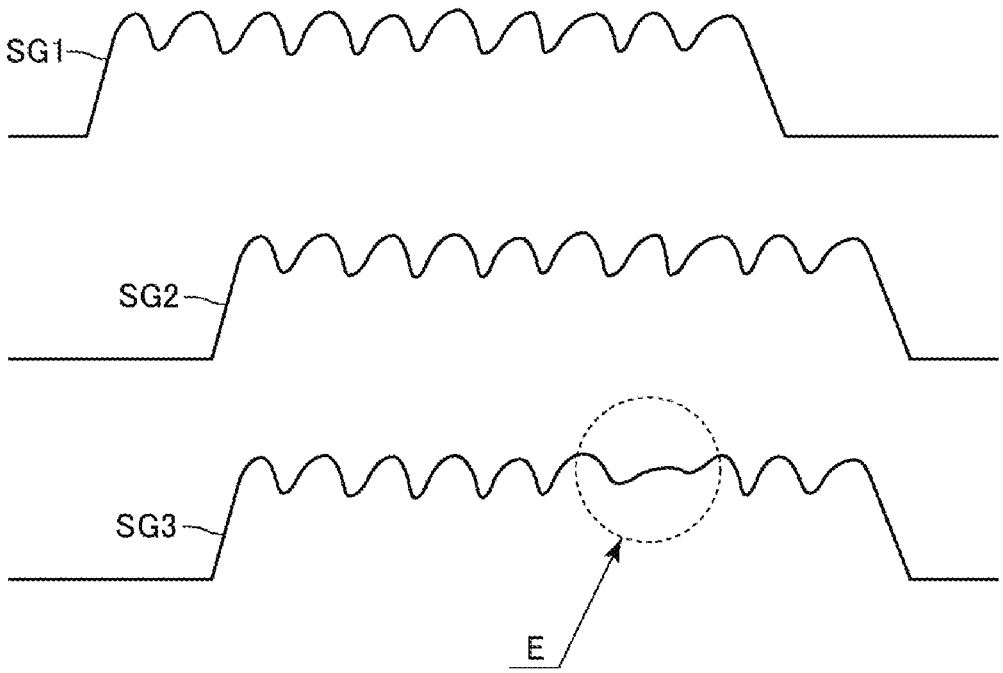
FIG. 16 is a view of an example of output signals from the sensors illustrated in FIG. 8.

Also, in the present embodiment, each of the three sensors 16 to 18 are mounted to the carriage 19 in a state offset from each other in the front-rear direction, so the number of cards 2 is able to be suitably calculated even if there is a scratch at a specific location on the one end surface 2*b* of a card 2 held in the card holding portion 3. That is, for example, if there is a scratch at a location by which the sensor 18 passes, on the one end surface 2*b* of one of the cards 2 held in the card holding portion 3, a peak may not appear in a specific location in the output signal SG3 of the sensor 18, as shown in section E in FIG. 16, but even in this case, the waveform of the output signal SG1 from the sensor 16 and the waveform of the output signal SG2 from the sensor 17 will be normal waveforms. Therefore, in the present embodiment, the number of cards 2 is able to be suitably calculated, even if there is a scratch at a specific location on the one end surface 2*b* of a card 2 held in the card holding portion 3.

In the present embodiment, the gaps between the cards 2 held in the card holding portion 3 are narrow, so the difference between the level of the output signals from the sensors 16 to 18 when the sensors 16 to 18 pass by the positions where the cards 2 are arranged, and the level of the output signals from the sensors 16 to 18 when the sensors 16 to 18 pass between the cards 2, is small. That is, the difference between the peaks and the bottoms of the output signals from the sensors 16 to 18 when detecting the cards 2 held in the card holding portion 3 is small. Therefore, when analog output signals output from the sensors 16 to 18 are input to the circuit board 23 via the cable 43, there may be noise in the output signals from the sensors 16 to 18, and the accuracy with which the number of cards 2 is calculated may decrease.

However, in the present embodiment, the processing circuit 48 that processes the output signals from the sensors 16 to 18 is mounted to the circuit board 22, and the processing circuit 48 outputs the calculation result of the number of cards 2 as a digital signal. That is, in the present embodiment, the digital signal processed by the processing circuit 48 is input to the circuit board 23 via the cable 43. Therefore, in the present embodiment, even if the difference between the peaks and the bottoms of the output signals from the sensors 16 to 18 when detecting the cards 2 held in the card holding portion 3 is small, the effect from noise is able to be eliminated, so the accuracy with which the number of cards 2 is calculated can be improved.

Also, with the present embodiment, the sensors 16 to 18 are mounted to the circuit board 22, so output signals from the sensors 16 to 18 that are less affected by noise than when the sensors 16 to 18 are mounted to a different circuit board than the circuit board 22, and this circuit board and the circuit board 22 are connected via a predetermined cable, can be processed by the processing circuit 48. Therefore, in the present embodiment, even if the difference between the peaks and the bottoms of the output signals from the sensors 16 to 18 when detecting the cards 2 held in the card holding portion 3 is small, the accuracy with which the number of cards 2 is calculated can be improved.

In the present embodiment, the cover member 11 that is made of transparent resin material is arranged between the sensors 16 to 18 and the cards 2. Therefore, in the present embodiment, the cover member 11 makes it possible to prevent the light emitting surfaces of the light emitting elements and the light receiving surfaces of the light receiving elements of the sensors 16 to 18 from becoming dirty. Also, in the present embodiment, the rib 3*n* that protrudes toward the left side is formed on the upper side and both front and rear sides of the cover member 11, on the right side wall section 3*c*, and the left surface of the cover member 11 is arranged to the right side of the left end surface of the rib 3*n*. Therefore, in the present embodiment, the cover member 11 is able to be inhibited from being scratched due to the cards 2 held in the card holding portion 3 contacting the cover member 11.

In the present embodiment, the positioning ribs 3*n*, 3*p*, and 3*r* for determining the position of the cards 2 in the left-right direction inside the holding box portion 3*a* are each formed protruding toward the inside in the left-right direction on both inside surfaces in the left-right direction of the holding box portion 3*a* of the card holding portion 3. Also, in the present embodiment, the distance L in the left-right direction between the left end surfaces of the ribs 3*n* and 3*p* and the right end surfaces of the ribs 3*r* is longer than the width in the transverse direction of the cards 2, and shorter than the sum of the width in the transverse direction of the cards 2 and the focus range of the sensors 16 to 18. Therefore, in the present embodiment, the cards 2 can be held in the card holding portion 3 such that the sensors 16 to 18 focus on the one end surfaces 2*b* of the cards 2 held in the card holding portion 3. Also, in the present embodiment, the cards 2 are more easily held in the card holding portion 3 compared to when the cards 2 are positioned in the left-right direction in the card holding portion 3 by the entire inside surface in the left-right direction of the card holding portion 3.

OTHER EMBODIMENTS

The embodiment described above is one example of a preferred embodiment of the present invention, but the invention is not limited to this. Various modified embodiments are possible without departing from the scope of the present invention.

Figure 17:
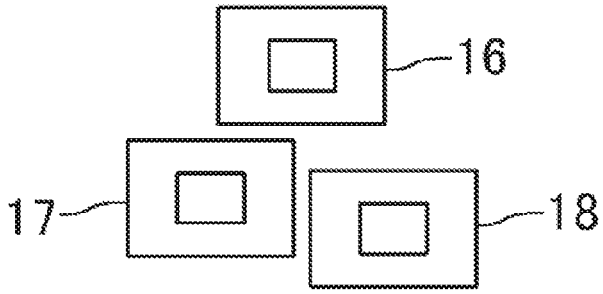
FIG. 17 is a view illustrating an arrangement of sensors according to another embodiment of the present invention.

In the embodiment described above, the sensor 17 and the sensor 18 are arranged at the same height, but the sensor 17 and the sensor 18 may be arranged at different heights, as illustrated in FIG. 17. That is, each of the three sensors 16 to 18 may be mounted to the carriage 19 in a state offset from each other in the up-down direction and offset from each other in the front-rear direction. In this case, it is possible to calculate the number of cards 2 on the basis of the three output signals that are at different detection positions and detecting timings and output from the three sensors 16 to 18, respectively, that are offset from each other in the up-down direction and the front-rear direction. Thus, in this case, it is possible to further improve the accuracy with which the number of cards 2 is calculated. Note that when each of the three sensors 16 to 18 is offset in the up-down direction, the three sensors 16 to 18 may be mounted to the carriage 19 so as to overlap in the front-rear direction.

In the embodiment described above, three of the sensors 16 to 18 are mounted to the carriage 19, but the number of sensors mounted to the carriage 19 may be one or two, or four or more. When two sensors are mounted to the carriage 19, the two sensors are mounted to the carriage 19 in a state offset in the up-down direction. Also, when four or more sensors are mounted to the carriage 19, at least one of the four sensors, and the other of the sensors, excluding this sensor, are mounted to the carriage 19 in a state offset in the up-down direction.

In the embodiment described above, the processing circuit 48 is mounted to the circuit board 22, but the processing circuit 48 may be mounted to the circuit board 23. Also, in the embodiment described above, the sensors 16 to 18 are mounted to the circuit board 22, but the sensors 16 to 18 may be mounted to a different circuit board than the circuit board 22, and this circuit board and the circuit board 22 may be connected via a predetermined cable. Also, in the embodiment described above, the correcting marks 39 and 40 are provided in positions facing the sensors 16 to 18 when the carriage 19 is in the home position, but the correcting marks 39 and 40 may also be omitted.

In the embodiment described above, the rib 3*n* is formed on the card holding portion 3, but the rib 3*n* does not have to be formed on the card holding portion 3. In this case, the ribs 3*p* and 3*r* are positioning ribs for determining the position of the cards 2 in the left-right direction inside the card holding portion 3. Also, in the embodiment described above, the ribs 3*p* do not have to be formed on the card holding portion 3. In this case, the ribs 3*n* and 3*r* are positioning ribs for determining the position of the cards 2 in the left-right direction inside the card holding portion 3. Also, in the embodiment described above, the ribs 3*n* and 3*p* do not have to be formed on the card holding portion 3. In this case, for example, the distance in the left-right direction between the left surface of the right side wall section 3*c* and the right end surfaces of the ribs 3*r* is longer than the width in the transverse direction of the cards 2, and shorter than the sum of the width in the transverse direction of the cards 2 and the focus range of the sensors 16 to 18.

In the embodiment described above, the ribs 3*r* are formed on both front and rear end sides of the left side wall section 3*d*, but the ribs 3*r* may be formed in a center position of the left side wall section 3*d* in the front-rear direction. Also, in the embodiment described above, the ribs 3*r* do not have to be formed on the card holding portion 3. In this case, for example, the distance in the left-right direction between the left end surfaces of the ribs 3*n* and 3*p* and the right surface of the left side wall section 3*d* is longer than the width in the transverse direction of the cards 2, and shorter than the sum of the width in the transverse direction of the cards 2 and the focus range of the sensors 16 to 18.

Also, in the embodiment described above, the ribs 3*n*, 3*p*, and 3*r* do not have to be formed on the card holding portion 3. In this case, for example, the distance in the left-right direction between the left surface of the right side wall section 3*c* and the right surface of the left side wall section 3*d* is longer than the width in the transverse direction of the cards 2, and shorter than the sum of the width in the transverse direction of the cards 2 and the focus range of the sensors 16 to 18. Also, in the embodiment described above, the cover member 11 is arranged between the cards 2 held in the card holding portion 3 and the sensors 16 to 18, but the cover member 11 does not have to be arranged between the cards 2 held in the card holding portion 3 and the sensors 16 to 18.

In the embodiment described above, the carriage 19 is movably held by the frame portion 21 and the carriage driving mechanism 20 is attached to the frame portion 21. Aside from this, for example, the carriage 19 may be movably held by the right side wall portion 3*h* of the card holding portion 3 and the carriage driving mechanism 20 may be attached to the right side wall portion 3*h* of the card holding portion 3. That is, the card counting mechanism 4 does not have to be able to detach from the card holding portion 3. In this case, the frame portion 21 becomes unnecessary. Also, in this case, the circuit board 22 and the circuit board 44 may be connected via a cable. That is, in this case, the circuit board 23 may be omitted.

In the embodiment described above, the sensors 16 to 18 are reflective optical sensors, but the sensors 16 to 18 may be transmissive optical sensors. Also, in the embodiment described above, the cards 2 are rectangular cards made of vinyl chloride each having a thickness of approximately 0.7 to 0.8 mm, but the cards 2 may be PET (polyethylene terephthalate) cards having a thickness of approximately 0.18 to 0.36 mm or paper cards having a predetermined thickness or the like. Also, in the embodiment described above, the cards 2 have a magnetic stripe 2*a*, but the cards 2 do not have to have the magnetic stripe 2*a*. Also, the card-type medium in the present invention may be card-type medium other than the cards 2.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

The invention claimed is:

1. A card-type medium counting mechanism that calculates the number of card-type medium, comprising:

an optical sensor configured to calculate the number of the card-type medium held so as to stack in a thickness direction of the card-type medium;

a carriage to which the sensor is mounted;

a circuit board that is fixed to the carriage; and a carriage driving mechanism structured to drive the carriage such that the sensor moves in the thickness direction of the card-type medium along an end surface of the card-type medium, wherein a processing circuit configured to process an output signal from the sensor and outputs a digital signal is mounted to the circuit board.

2. The card-type medium counting mechanism according to claim 1, wherein the sensor is mounted to the circuit board.

3. The card-type medium counting mechanism according to claim 1, wherein the sensor is a reflective optical sensor that includes a light emitting element that emits light toward the card-type medium, and a light receiving element that receives light reflected by the card-type medium.

4. A card-type medium holding device comprising:

a card-type medium counting mechanism structured to calculate a number of card-type medium;

a card-type medium holding portion within which a plurality of the card-type medium are held so as to stack in a thickness direction of the card-type medium;

wherein the card-type medium counting mechanism comprises:

an optical sensor configured to calculate the number of the card-type medium held so as to stack in the thickness direction of the card-type medium;

a carriage to which the sensor is mounted;

a circuit board that is fixed to the carriage; and a carriage driving mechanism structured to drive the carriage such that the sensor moves in the thickness direction of the card-type medium along an end surface of the card-type medium, wherein a processing circuit that processes an output signal from the sensor and outputs a digital signal is mounted to the circuit board, and wherein the card-type medium counting mechanism is attached to the card-type medium holding portion, and calculates the number of card-type medium held in the card-type medium holding portion.

5. The card-type medium holding device according to claim 4, wherein:

the sensor is a reflective optical sensor that includes a light emitting element that emits light toward the card-type medium, and a light receiving element that receives light reflected by the card-type medium, when one direction in the thickness direction of the card-type medium is a first direction, before counting the number of card-type medium, the carriage is standing by in a home position in which the sensor is arranged on the first direction side of the card-type medium arranged farthest on the first direction side inside the card-type medium holding portion, a correcting mark is provided in a position facing the sensor when the carriage is in the home position, and sensitivity of the sensor is automatically corrected on the basis of a detection result at the light receiving element, of light emitted from the light emitting element and reflected by the correcting mark.

6. The card-type medium holding device according to claim 5, wherein:

the card-type medium counting mechanism comprises a frame portion that movably holds the carriage and to which the carriage driving mechanism is attached, and the frame portion is detachably attached to the card-type medium holding portion.

7. A card-type medium counting mechanism that calculates the number of card-type medium, comprising:

a plurality of optical sensors configured to calculate the number of the card-type medium held so as to stack in a thickness direction of the card-type medium;

a carriage to which the plurality of sensors are mounted; and a carriage driving mechanism structured to move the carriage such that the plurality of sensors move in the thickness direction of the card-type medium along an end surface of the card-type medium, wherein at least one of the sensors, of the plurality of sensors, and the other of the sensors, excluding this sensor, are mounted to the carriage in a state offset in the thickness direction of the card-type medium.

8. The card-type medium counting mechanism according to claim 7, wherein the sensors are reflective optical sensors each of which includes a light emitting element that emits light toward the card-type medium, and a light receiving element that receives light reflected by the card-type medium.

9. The card-type medium counting mechanism according to claim 7, characterized by comprising:

a circuit board that is fixed to the carriage, wherein a processing circuit that processes output signals from the sensors is mounted to the circuit board, and the sensors are mounted to the circuit board.

10. The card-type medium counting mechanism according to claim 7, wherein:

when a direction orthogonal to an emission direction of light from the light emitting elements of the sensors and the thickness direction of the card-type medium is a first direction, each of the plurality of sensors is mounted to the carriage in a state offset from each other in the thickness direction of the card-type medium and offset from each other in the first direction.

11. A card-type medium holding device characterized by comprising:

a card-type medium counting mechanism that calculates the number of card-type medium; and a card-type medium holding portion within which a plurality of the card-type medium are held so as to stack in a thickness direction of the card-type medium, wherein the card-type medium counting mechanism comprises:

a plurality of optical sensors configured to calculate the number of the card-type medium held so as to stack in the thickness direction of the card-type medium;

a carriage to which the plurality of sensors are mounted; and a carriage driving mechanism that moves the carriage such that the plurality of sensors move in the thickness direction of the card-type medium along an end surface of the card-type medium, wherein at least one of the sensors, of the plurality of sensors, and the other of the sensors, excluding this sensor, are mounted to the carriage in a state offset in the thickness direction of the card-type medium, and wherein the card-type medium counting mechanism is attached to the card-type medium holding portion, and counts the number of card-type medium held in the card-type medium holding portion.

12. The card-type medium holding device according to claim 11, wherein:

the sensors are reflective optical sensors each of which comprises a light emitting element that emits light toward the card-type medium, and a light receiving element that receives light reflected by the card-type medium, when one direction in the thickness direction of the card-type medium is a second direction, before counting the number of card-type medium, the carriage is standing by in a home position in which the sensors are arranged on the second direction side of the card-type medium arranged farthest on the second direction side inside the card-type medium holding portion, a correcting mark is provided in a position facing the sensors when the carriage is in the home position, and sensitivity of the sensors is automatically corrected on the basis of detection results at the light receiving elements, of light emitted from the light emitting elements and reflected by the correcting mark.

13. The card-type medium holding device according to claim 11, wherein:

the card-type medium counting mechanism comprises a frame portion that movably holds the carriage and to which the carriage driving mechanism is attached, and the frame portion is detachably attached to the card-type medium holding portion.

14. A card holding device within which a rectangular card having a magnetic stripe formed along a longitudinal direction of the card is housed, comprising:

a card holding portion within which the card is held so as to stack in a thickness direction of the card;

a reflective optical sensor structured to calculate the number of the cards held in the card holding portion;

a carriage to which the sensor is mounted; and a carriage driving mechanism structured to move the carriage such that the sensor moves in the thickness direction of the card along an end surface of the card, wherein the magnetic stripe is formed farther toward one end surface side in a transverse direction of the card than the center in the transverse direction of the card, the cards are held in the card holding portion such that the one end surface of each of the cards faces the same direction, when a longitudinal direction of the card held in the card holding portion is a first direction, the transverse direction of the card held in the card holding portion is a second direction, and a side, in the second direction, on which the one end surface of the card is arranged is a magnetic stripe side, the sensor is arranged on the magnetic stripe side of the card holding portion, and moves in the thickness direction of the card along the one end surface of the card.

15. The card holding device according to claim 14, wherein the card holding portion comprises a translucent cover member arranged between the sensor and the card.

16. The card holding device according to claim 15, wherein a rib that protrudes inward in the second direction is formed on both sides of the cover member in the first direction of the card holding portion.

17. The card holding device according to claim 14, wherein:

a positioning rib for positioning the card in the second direction inside the card holding portion is provided protruding inward in the second direction, on each of both inside surfaces in the second direction of the card holding portion, and a distance in the second direction between the positioning rib formed on one of the inside surfaces in the second direction of the card holding portion and the positioning rib formed on the other of the inside surfaces in the second direction is longer than a width in the transverse direction of the card, and shorter than a sum of the width in the transverse direction of the card and a focus range of the sensor.

18. The card holding device according to claim 14, characterized by comprising:

a frame portion that movably holds the carriage and to which the carriage driving mechanism is attached, wherein the frame portion is detachably attached to the card holding portion.

* * * * *